US009522296B2

(12) United States Patent
Davies, III

(10) Patent No.: US 9,522,296 B2
(45) Date of Patent: Dec. 20, 2016

(54) LOCKING MECHANISM

(71) Applicant: David Robert Davies, III, North Chesterfield, VA (US)

(72) Inventor: David Robert Davies, III, North Chesterfield, VA (US)

(73) Assignee: Atlas Barbell, LLC, North Chesterfield, VA (US)

( * ) Notice: Subject to any disclaimer, the term of this patent is extended or adjusted under 35 U.S.C. 154(b) by 5 days.

(21) Appl. No.: 14/702,193

(22) Filed: May 1, 2015

(65) Prior Publication Data

US 2015/0231441 A1 Aug. 20, 2015

Related U.S. Application Data

(63) Continuation-in-part of application No. 14/190,133, filed on Feb. 26, 2014, now Pat. No. 9,084,913, which is a continuation-in-part of application No. 13/790,675, filed on Mar. 8, 2013, now Pat. No. 9,095,743.

(51) Int. Cl.
*A63B 21/072* (2006.01)
*A63B 21/075* (2006.01)
*A63B 21/00* (2006.01)

(52) U.S. Cl.
CPC ..... *A63B 21/0728* (2013.01); *A63B 21/1469* (2013.01)

(58) Field of Classification Search
CPC ..... A63B 21/072; A63B 21/0724; A63B 21/0726; A63B 21/0728; A63B 21/075
USPC ..... 482/92, 93, 106–108
See application file for complete search history.

(56) References Cited

U.S. PATENT DOCUMENTS 4,141,117 A * 2/1979 Van Gompel ..... F16G 11/00 24/136 A
4,579,337 A * 4/1986 Uyeda ..... A63B 21/0728 403/259
5,163,887 A * 11/1992 Hatch ..... A63B 21/075 482/106
5,697,871 A * 12/1997 Landfair ..... A63B 21/0728 482/107
6,007,268 A * 12/1999 Whittington ..... A63B 21/0728 403/110
6,059,700 A * 5/2000 Ellenburg ..... A63B 21/0728 482/107

* cited by examiner

*Primary Examiner* — Stephen Crow
*Assistant Examiner* — Garrett Atkinson
(74) *Attorney, Agent, or Firm* — Whitham, Curtis & Cook, P.C.

(57) ABSTRACT

A locking mechanism for a shaft provides secure frictional engagement to the shaft while manually operable to be removed from the shaft. There is a first cylinder allowable to slide freely on the shaft. One or more holes retaining one or more balls allow a projection of the balls into an interior of the first cylinder. A tensioning ring (second cylinder) partially overlaps the first cylinder, retains the balls within the holes, and has at least a portion of the inside diameter increasing in diameter. A biasing mechanism acts against the second cylinder to urge the balls into the first cylinder interior to frictionally engage the shaft. Two release mechanisms movable with the biasing mechanism manually actuated against the bias move the second cylinder to allow the balls to freely move within the holes and the locking mechanism to be slid onto and removed from the shaft.

8 Claims, 25 Drawing Sheets

SECTION A-A

SECTION B-B

LOCKING MECHANISM

CROSS-REFERENCE TO RELATED APPLICATIONS

This application is a continuation-in-part (CIP) application of U.S. patent application Ser. No. 14/190,133 filed Feb. 26, 2014, now U.S. Pat. No. 9,084,913, which itself is a CIP application of U.S. patent application Ser. No. 13/790,675 filed Mar. 8, 2013, now U.S. Pat. No. 9,095,743, the complete contents of both being herein incorporated by reference and the priority of both is hereby claimed.

FIELD OF THE INVENTION

The invention generally relates to a locking mechanism for a shaft to secure and attach to a shaft and, more particularly, to a weight and locking mechanism which are intended for, but not limited to, attachment to one another for locking the weight to a barbell.

BACKGROUND

A barbell and weight plates are very common and well known pieces of equipment for weight lifting exercises. A barbell commonly has a shaft with a central section suited for a user to grasp during use of the equipment and two terminal sections, one at either end of the barbell, suited for bearing and retaining weight plates. Weight plates are commonly cylindrical (for safety, aesthetic, weight distribution, and mass centering purposes, among others) with a hole through the center. The hole is sized to facilitate the placement of matching weight plates on each of the terminal sections of the barbell.

Different quantities of weight are required or desirable for different users and for different exercises with a barbell, for instance when exercising different muscle groups. Barbells and weight plates are commonplace in any professional gym or home gym and are most often used by a plurality of users with different weight requirements. It is important that weight plates be easy to mount on and remove from the terminal sections of barbells so that different combinations of weight plates can be used to achieve different total quantities of weight customized to each particular user for each particular exercise.

It is furthermore important that the weight plates be completely fixed relative to the barbell during use. At a minimum, this involves the weight plates sufficiently resisting movement (i.e., sliding) in either axial direction with respect to the bar or shaft. This is necessary to prevent the weights from unintentionally changing position along the bar or possibly slipping off the bar altogether. Changing position along the bar and slipping off the bar would change the balance and loading characteristics of the weighted bar and thereby present a potential risk of harming the user as well as the user's surroundings, possibly including property, floor surfacing, other weight equipment, persons, pets, plants, or anything else in the user's vicinity. It is therefore important to have a means of securely fixing a weight on the barbell in order to prevent it unintentionally slipping.

Fixing the relative position of a weight with respect to a barbell is traditionally achieved by securing the weight on both sides and thus preventing movement in both axial directions. Each side of a weight is traditionally held fixed relative to the barbell by one of three possible arrangements. A weight added to an otherwise unloaded terminal section of a barbell is usually mounted on the bar until abutment with a stopper. This stopper, sometimes a part of the barbell itself, is by design intended to eliminate movement in one axial direction of the first weight. If a second weight is added, the second weight is slid onto the bar until a face of the second weight abuts with the opposing face of the first weight. The first weight becomes "sandwiched" between the stopper and the second weight. Each successive weight added completes a "sandwich" on the weight which precedes it. The final weight mounted is most often followed by a collar, the collar possessing a means to lock and unlock to the barbell.

Many locking collars for a bar or shaft are well known in the art. A large number use some variation of a bolting mechanism, whereby tightening a radial bolt within the collar drives the bearing surface of the bolt against the bar to create a compressive force. The resulting forces within the bolt-collar-bar system provides resistance to changes in the relative position of the collar with respect to the bar while the bolt remains tightened. One significant limitation of bolt devices is the time and inconvenience involved in turning the bolt successive times to both lock and unlock the collar. It is furthermore unclear to the user when the bolt is "tight enough," resulting in many users over-tightening the bolt and risking damage to the bar and making un-tightening difficult.

Locking collars such as those disclosed in U.S. Pat. Nos. 4,893,810 and 6,007,268 use different implementations of metal balls which are contained between a coaxial inner collar and outer collar. A spring which bears upon a flange at either end of the spring provides a biasing force to provide a constant relative position of the inner collar with respect to the outer collar. In an isolated state (without external forces being imposed by a user), the metal balls partially protrude into the collar's central cylindrical cavity. This provides radial bearing on the bar which, like the bolt described above, holds the collar against the bar to limit the collar's ability to slide along the bar.

When a user changes the axial position of the inner collar relative to the other collar—either by pulling them apart, as is done in U.S. Pat. Nos. 4,893,810 and 6,007,268, or by pushing the collars together, as is done in U.S. Pat. No. 5,295,934—the balls are freed to move radially and therefore do not necessarily protrude into the collar's central cavity. While in this temporary unlocked state the collar can be freely slid along the bar. When the user stops applying a compressive or tensile force to the device, the collar returns to its original locked conformation. Locking collars of this type have the limitation that a user must apply a constant compressive or tensile force while adjusting the position of the collar along the bar.

A considerable limitation of any of the above described collars known in the art is the dependence on the elimination of gaps between stacked weights in order to achieve effective use. When small gaps are present, a collar lock prevents weights from sliding off the barbell but does nothing to prevent them axially sliding small amounts during use. This presents the danger of changing the bar's balance and loading characteristics while in use, which can, for instance, increase the risk of the user accidently dropping the barbell to one side. When large gaps are present, it is possible that a sliding weight could gain sufficient momentum to overcome the resistive forces of the collar upon impact with the collar and result in the collar and weight sliding off the barbell during use. In short, collars up this point have only offered limiting axial movement of a weight on a bar in one direction.

SUMMARY

It is a general object of the present invention to provide a novel locking mechanism for use on a bar or shaft.

It is a further object of the present invention to provide a weight and locking mechanism which can be slid onto and fixed to a bar or shaft, for instance a weight-lifting barbell, without an additional tool such as a locking collar.

According to the present invention, these and other objects and advantages are achieved in a locking mechanism for a shaft which comprises a first cylinder having at least a portion of an inside diameter approximately equal to an outside diameter of the shaft allowing for the cylinder to slide freely on the shaft. The cylinder has one or more holes. One or more balls are retained in respective ones of the holes of the first cylinder. The holes allow a projection of retained balls into an interior of the first cylinder but is small enough to retain the balls in the holes. The locking mechanism further comprises a tensioning ring in the form of a second cylinder at least partially overlapping the first cylinder. The tensioning ring has an inside diameter approximately equal to an outside diameter of the first cylinder at one end and at least a portion of the inside diameter increasing in diameter toward an opposite end. The second cylinder serves to retain the balls within the holes of the first cylinder. A biasing mechanism acts against the second cylinder in a first direction to urge the balls into the interior of the first cylinder in order to frictionally engage the shaft. First and second release mechanisms movable with the biasing mechanism may be manually actuated against the bias to move the second cylinder in a second direction opposite the first direction to allow the balls to freely move within their respective holes and allow the locking mechanism to be slid onto and removed from the shaft. The first release mechanism is actuated by a pulling force, a rotational force, or a simultaneously supplied pulling and rotational force and the second release mechanism is actuated by a pushing force. In one embodiment the locking mechanism may be integrally or separably attached to a weight for removably attaching the weight to the shaft.

DETAILED DESCRIPTION

Figure 1:
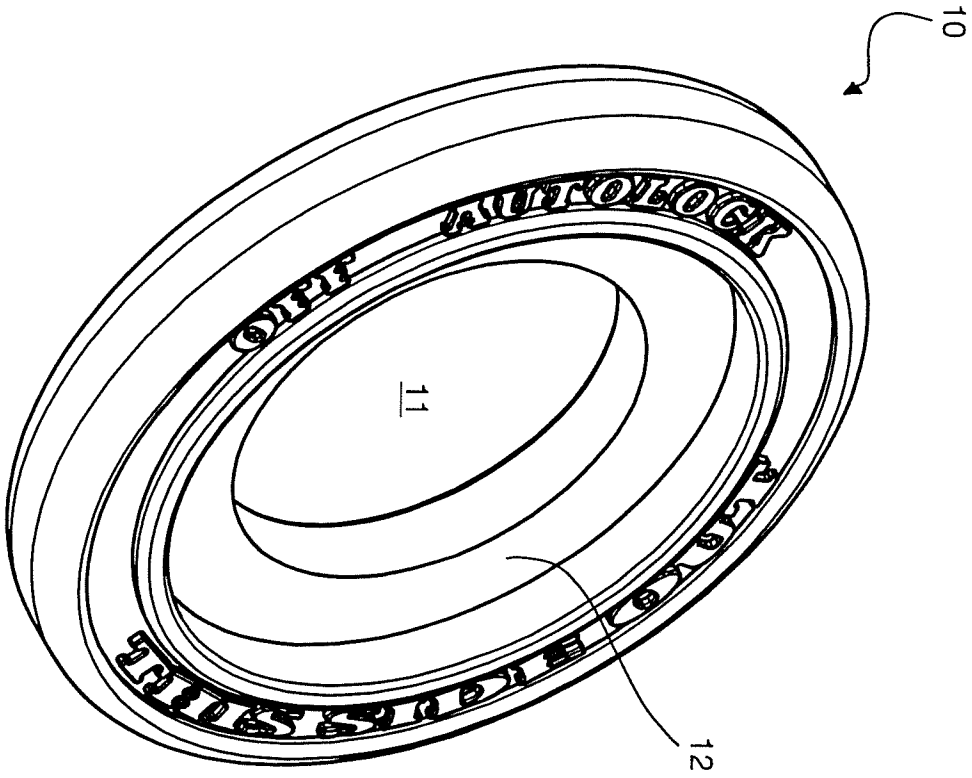
FIG. 1 is a perspective view of a weight that may be used in combination with the locking mechanism of the present invention.

Referring to the drawings and more particularly to FIG. 1, weight 10 with central hole 11 may be used for adding a certain number of pounds or kilograms to weight-lifting equipment such as a barbell or dumbbell. Weight 10 may take any weight, for instance 5 pounds, 10 pounds, 20 kilograms, 25 kilograms, or any other mass or weight which would be desirable for the weight's intended use, such as weightlifting. The weight 10 has a circular shape, as is conventional, but is distinguished by a recess 12 in one face. This recess is for receiving the locking mechanism according to the invention to form a weight assembly.

Weight assembly 20, including a weight 10 and an attached locking mechanism 21 according to the present invention, is shown in FIGS. 2A-2B and 3A-3B which show opposite side views of the weight assembly. Central hole 22 of the locking mechanism is sized to permit passage of a shaft such as the bar of a barbell and has at least a portion of an inside diameter approximately equal to an outside diameter of a shaft with which weight assembly 20 may be used. Locking mechanism 21 is selectively operable to be in an unlocked position, allowing the locking mechanism to be freely slidable onto and off of the shaft, and a locked position, securing the weight assembly on the shaft. Locking mechanism 21 may be switched between a locked position and an unlocked position by a first release mechanism 24, shown in FIGS. 2A and 2B, or a second release mechanism 31, shown in FIGS. 3A and 3B, disposed on opposite sides of the locking mechanism. Either release mechanism may be operated individually or both may be operated simultaneously. The release mechanisms provide alternative actuation means for locking mechanism 21. Release mechanism 24 may be actuated by a pulling force, a rotational force, or a simultaneously supplied pulling and rotational forces. Release mechanism 31 may be actuated by a pushing force. Alternate embodiments of the present invention may have just one of release mechanism 24 or release mechanism 31. This may be desirable, for example, in an application where only one side of locking mechanism 21 is readily accessible.

Figure 2A:
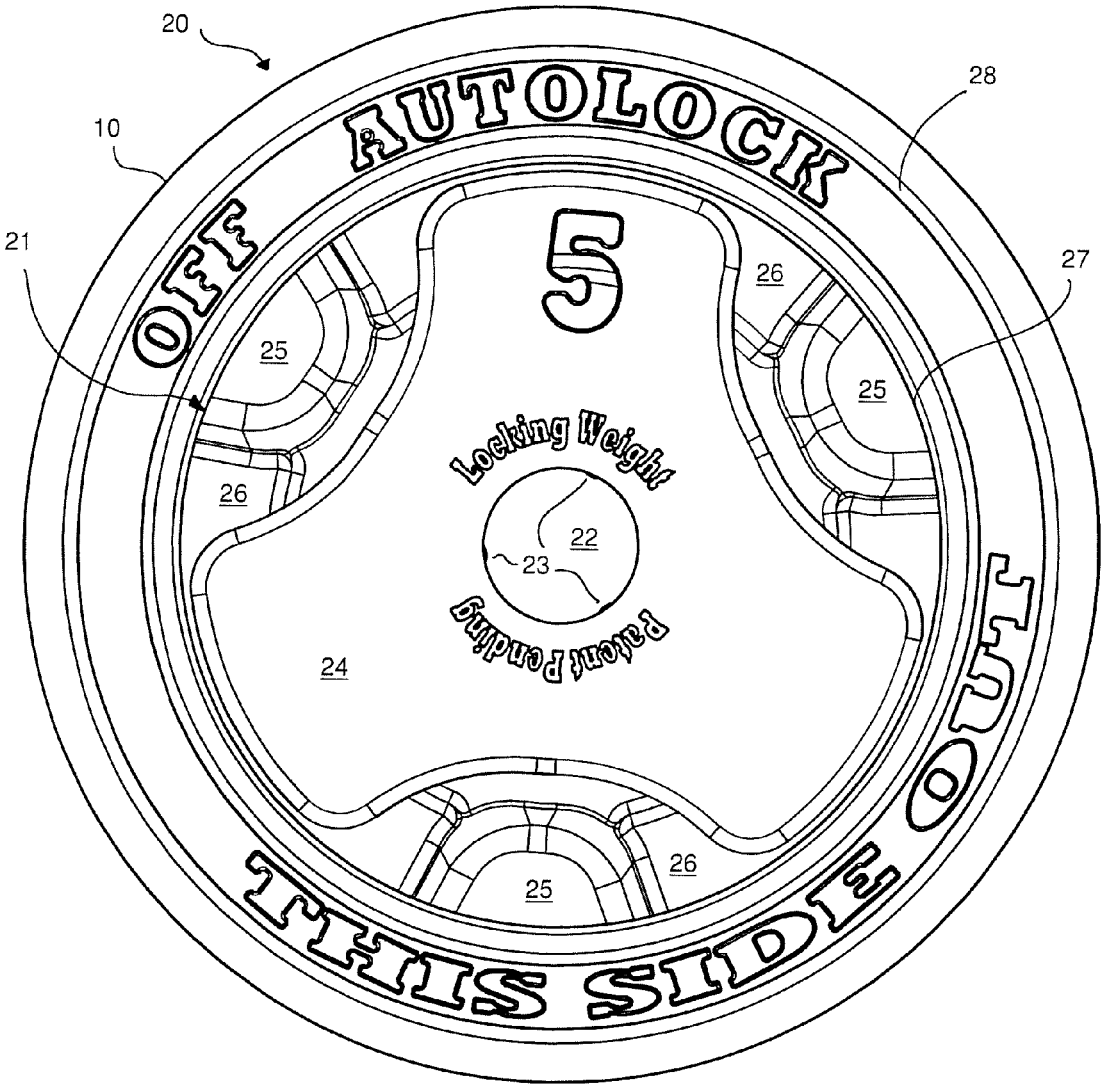
FIGS. 2A and 2B are, respectively, a front elevation view and a front isometric view of a weight assembly comprising the weight of FIG. 1 and an embodiment of the locking mechanism of the present invention.
Figure 2B:
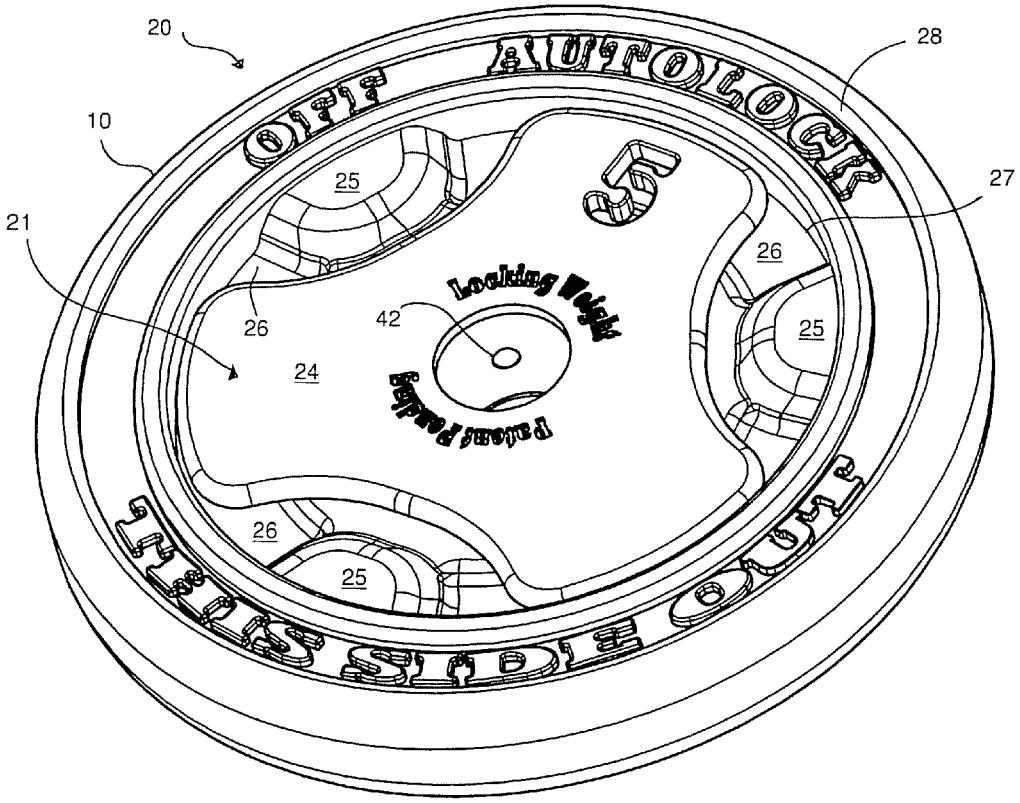

Referring to FIGS. 2A and 2B, an exemplary embodiment of locking mechanism 21 according to the present invention has release mechanism 24 in the form of a pull-plate. The pull-plate comprises a radially extending flange integral with the first release mechanism and may be pulled a short distance perpendicularly with respect to face 28 of weight assembly 20 to switch the locking mechanism from a locked position to an unlocked position. A radially extending flange 26 integral with a biasing mechanism and located between the first and second release mechanisms has peripheral cam surfaces 25 about a circumferential edge 27 of flange 26. Pull-plate 24 having mating cam surfaces 47 (shown in FIG. 4) may be rotated either clockwise or counterclockwise to engage mating cam surfaces 47 with peripheral cam surfaces 25 to maintain the locking mechanism in an unlocked condition to facilitate sliding the weight assembly on and off the shaft with or without continued actuation of either release mechanism. Rotation of pull-plate 24 for engaging or disengaging mating cam surfaces 47 with the peripheral cam surfaces 25 may be done without a pulling force, subsequent to a pulling force, or simultaneous with a pulling force enacted upon pull-plate 24. Alternative embodiments of first release mechanism 24 may be in the form of a dial, a loop, a handle, a knob, or any other structure which may be actuated by a pulling force, rotational force, or both a pulling force and rotational force supplied simultaneously. Mating cam surfaces 47 may be integral with or fixedly attached to release mechanism 24 so that release mechanism 24 and mating cam surfaces 47 are movable in unison.

Figure 3A:
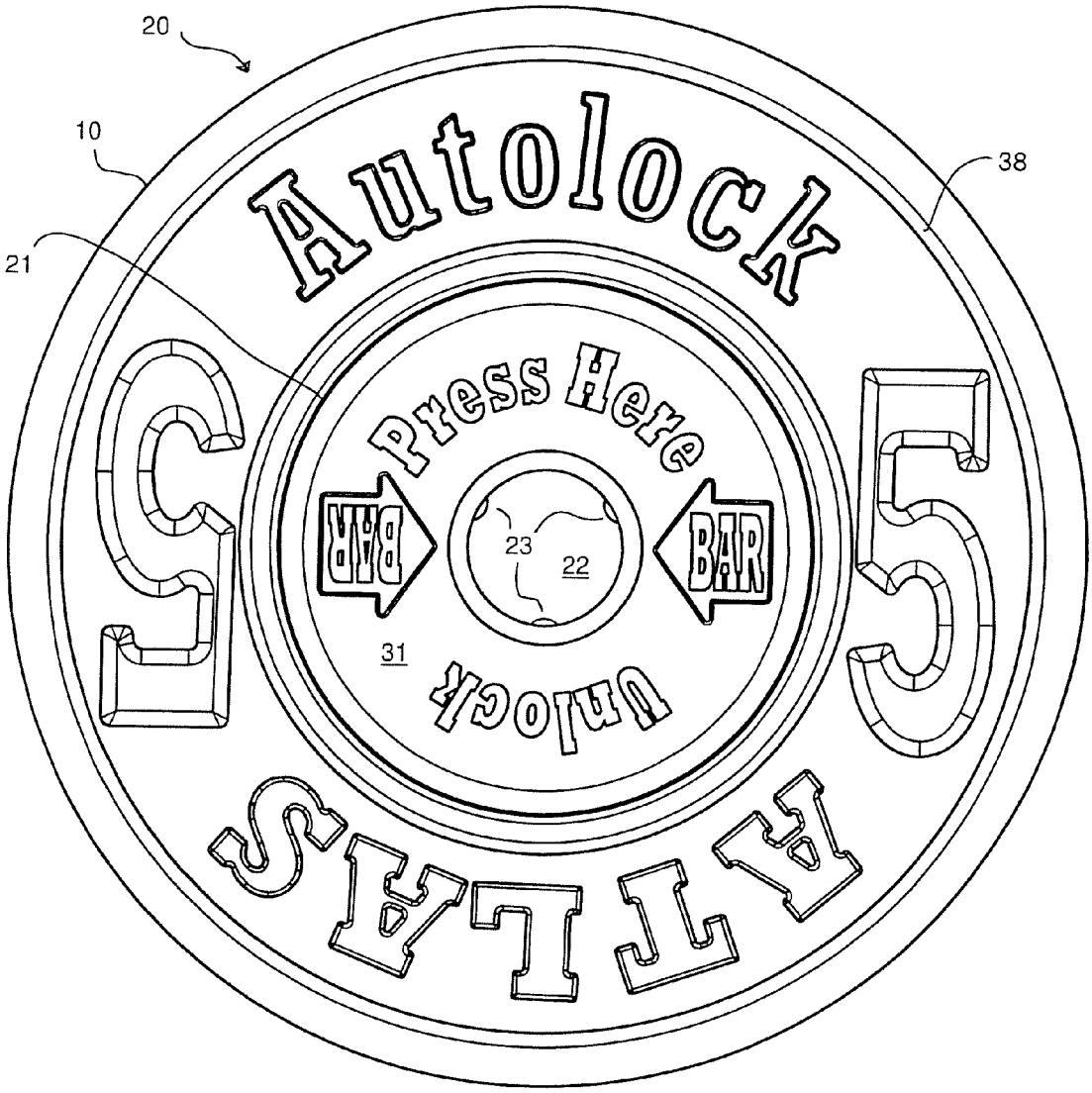
FIGS. 3A and 3B are, respectively, a back elevation view and a back isometric view of the weight assembly shown in FIGS. 2A and 2B.
Figure 3B:
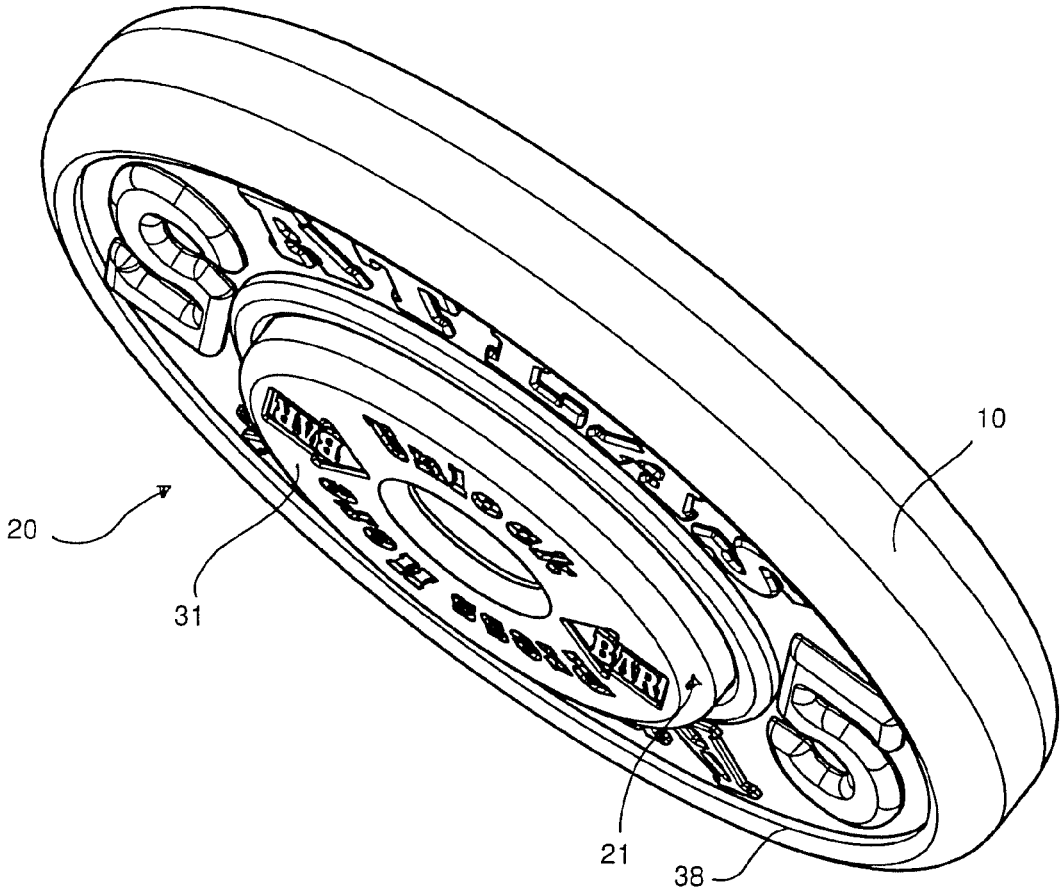

FIGS. 3A and 3B are, respectively, a back elevation view and a back isometric view of weight assembly 20 shown in FIGS. 2A and 2B. Second release mechanism 31 in the form of a push-button may be actuated by a pushing force which pushes push-button 31 a short distance perpendicularly with respect to face 38 of weight assembly 20. The push-button may be of any diameter compatible with the dimensions of central hole 11 of weight 10 and the dimensions of the other components of locking mechanism 21. Other embodiments of release mechanism 31 may comprise dimples, depressions, hooks, handles, or other structural forms which provide for actuation by a pushing force or, alternatively, both a pushing force and a rotational force. A structural provision for actuation of release mechanism 31 by a rotational force would allow the mating cam surfaces 47 integral with release mechanism 24 on the opposite side of the locking mechanism to engage or disengage with peripheral cam surfaces 25.

Figure 4:
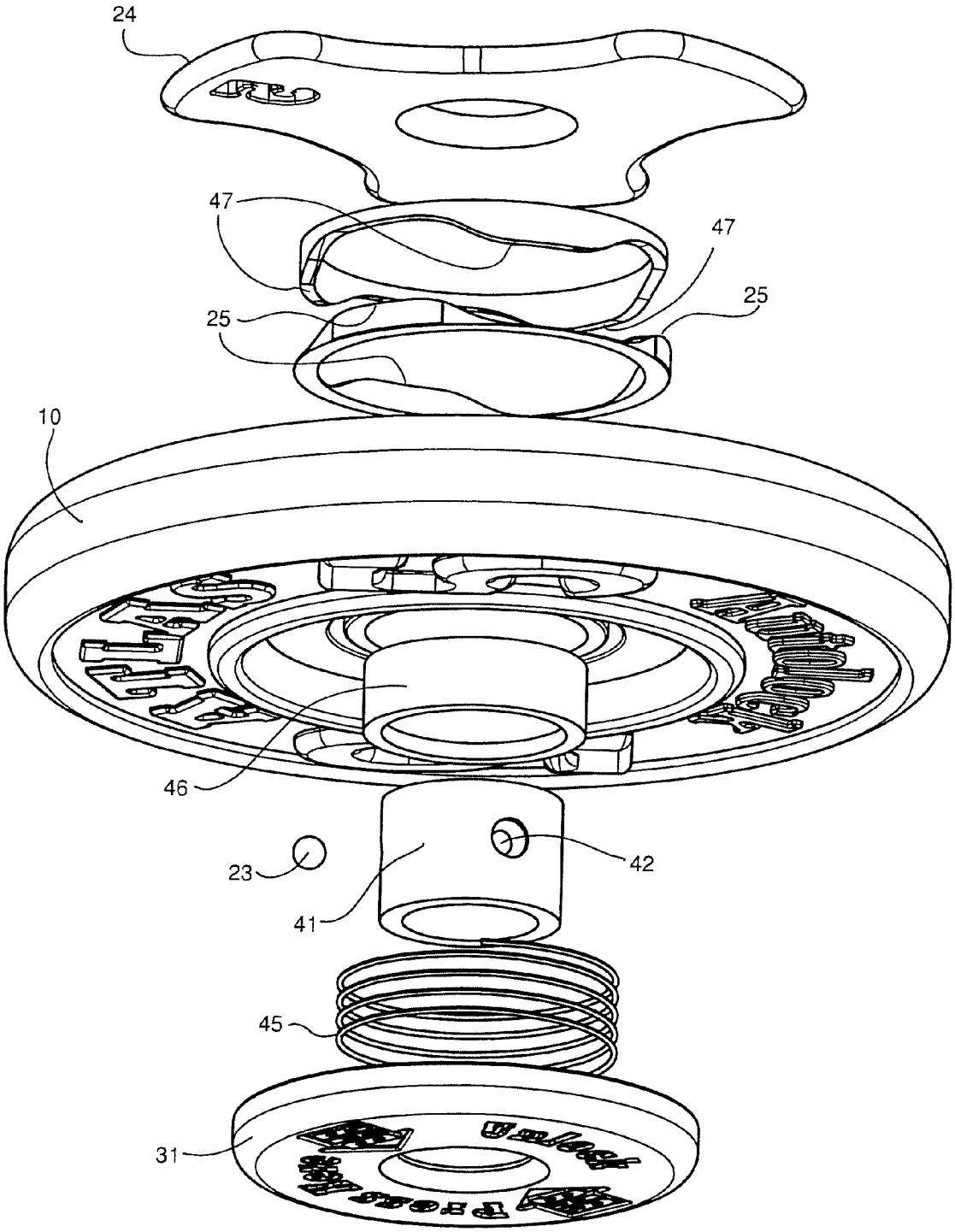
FIG. 4 is an exploded isometric view of a weight assembly comprising the weight of FIG. 1 and an embodiment of the locking mechanism of the present invention.

Referring to FIG. 4, locking mechanism 21 has a first cylinder 41 the interior of which is central hole 22. Interior 22 allows for the cylinder to slide freely onto the shaft when in the unlocked configuration. Cylinder 41 has at least one hole 42 each of which retains a ball 23. There may be as few as one hole and one ball, more preferably two holes and two balls, most preferably three to six holes and three to six balls or a higher number of holes each with a respective ball. One skilled in the art will recognize that the number of holes and balls may be selected to optimize the force distribution as needed between the balls and the shaft when the locking mechanism is in a locked configuration, example forces being the bearing forces between at least one ball 23 and the shaft and the frictional forces between the interior wall of cylinder 41 and the shaft. The exemplary embodiment of the locking mechanism according to the present invention as illustrated in FIGS. 2A and 3A have three balls 23 each within a respective hole 42. Holes 42 serve to retain balls 23 while allowing a projection or protrusion of balls 23 into the interior 22 of cylinder 41. Each of the plurality of balls may have a diameter which is the same or different from the diameter of one or more other balls. At least one hole 42 may be an opening or hole which is oriented radially to cylinder 41 or oriented at an angle with respect to a radial direction of cylinder 41. Holes 42 may be tapered holes or may be holes each of a constant diameter of the ball retained but terminating in an aperture having a diameter less than that of the ball in order to prevent the ball from falling out of the hole. It is preferred that all holes are aligned axially in one common circumference about cylinder 41, but one skilled in the art will recognize that one or more of the holes may be axially spaced from one another along cylinder 41 to achieve alterations to the force distribution between the locking mechanism 21 and the shaft.

With continued reference to FIG. 4, first and second release mechanisms 24 and 31 are movable with a biasing mechanism which comprises compression spring 45 coaxial to cylinder 41 and which biases locking mechanism 21 toward a locked position. The biasing mechanism may be partially or fully enclosed within locking mechanism 21. This serves the purpose of, for example, shielding the biasing mechanism from foreign objects and reducing the risk to the user of possible injury such as pinching. Tensioning ring 46 in the form of a second cylinder at least partially overlapping first cylinder 41 has an inside diameter approximately equal to an outside diameter of the first cylinder 41 at one end of second cylinder 46. At least a portion of the inside diameter of cylinder 46 increases in diameter size toward an opposite end of cylinder 46. The portion may be one or more arcs of the total diameter of the tensioning ring, and the tapered surface resulting from the increase in diameter may extend the total length to the opposite end of cylinder 46 or may extend only a part of the total length of tensioning ring 46. Tensioning ring 46 serves to retain balls 23 within respective holes 42. Balls 23 remain tangent to an inner surface of tensioning ring 46 and to the outer surface of the shaft during use.

Figure 5B:
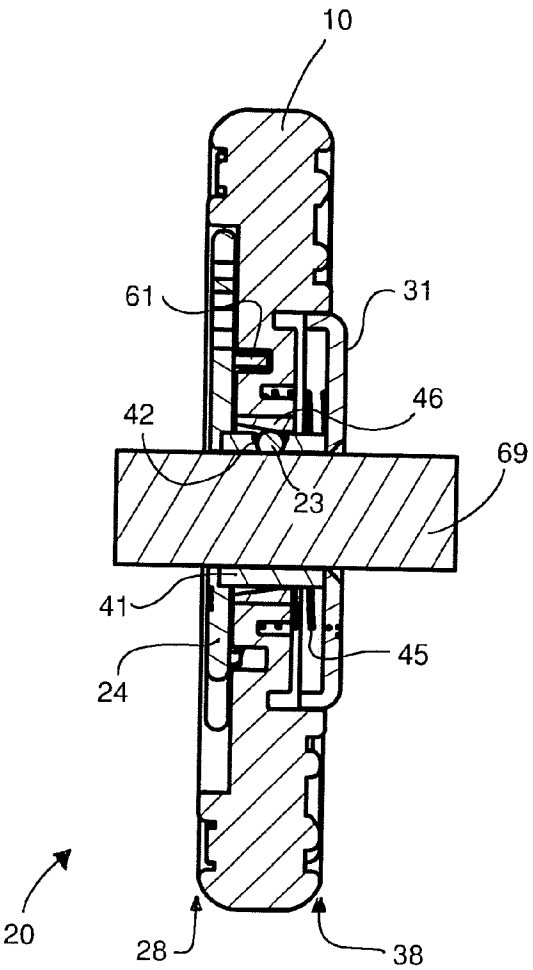
FIGS. 5A, 5B, and 5C are, respectively, a front elevation view, a cross-sectional side view, and a back isometric view of a weight assembly on a cylindrical shaft or bar with an integral locking mechanism of the present invention in a locked configuration.
Figure 5A:
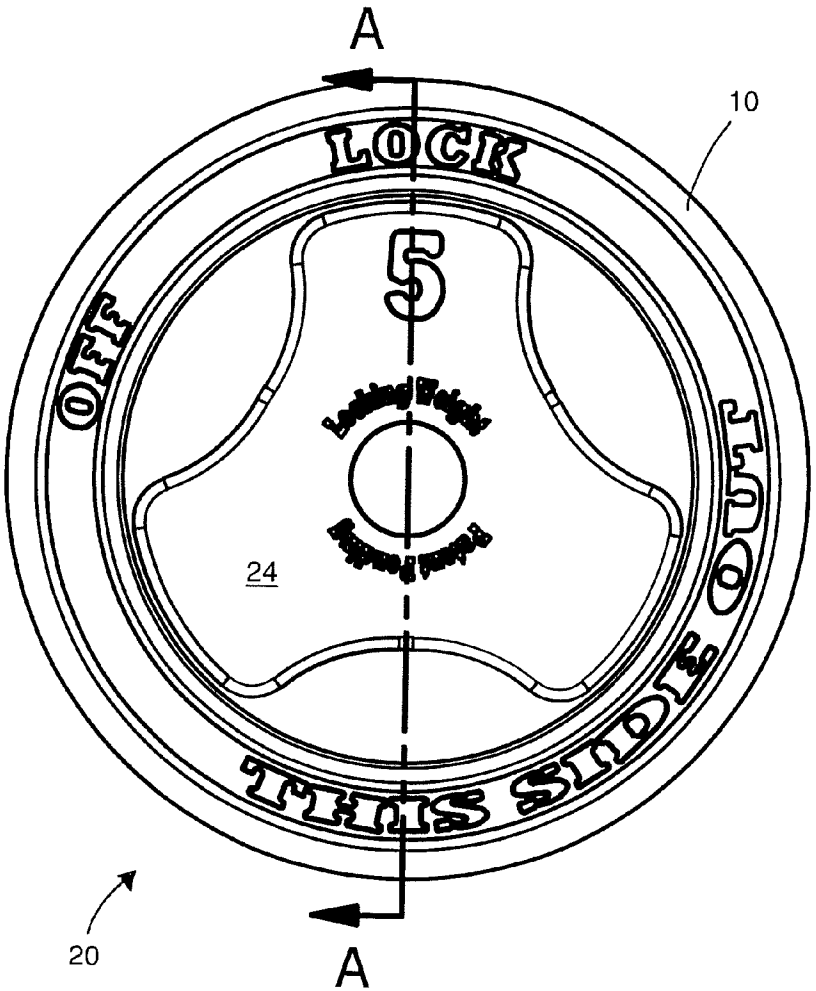
Figure 5C:
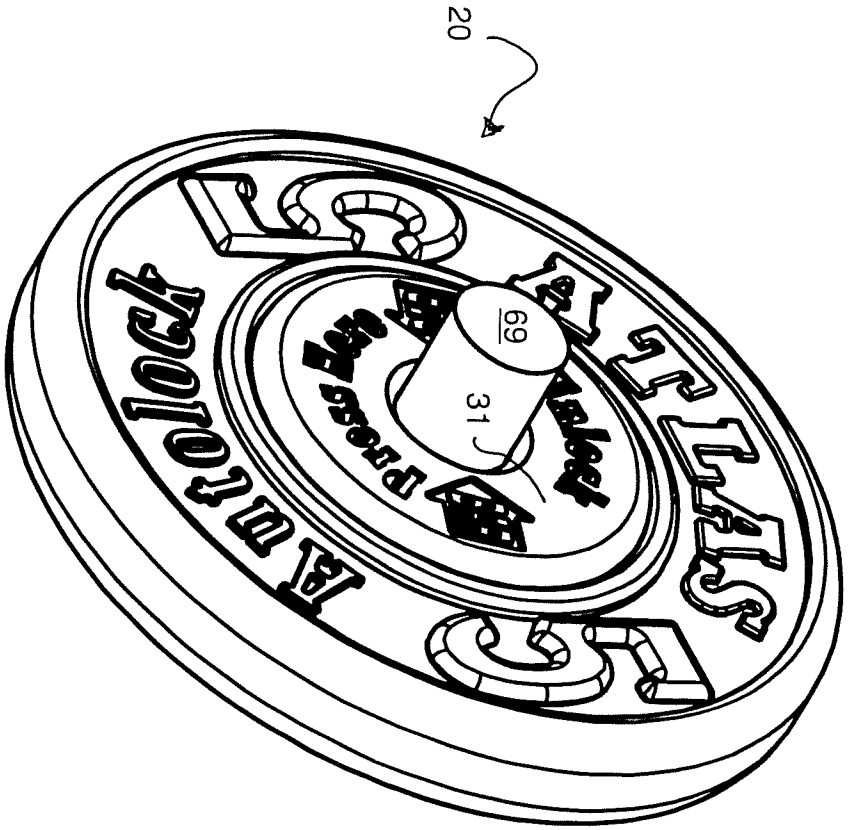

FIGS. 5A, 5B, and 5C show weight assembly 20 in a locked position loaded on a shaft 69. The length of compression spring 45 in the locked position is always less than its relaxed length in the unlocked position such that the biasing mechanism is always in compression and always exerting a bias upon cylinder 46. Compression spring 45 acts against tensioning ring 46 and flange 26, these being preferably integral with one another, in a direction which urges one or more balls 23 into the interior of cylinder 41 in order to frictionally engage a shaft inserted through center hole 22. Tensioning ring 46 is oriented relative to the force supplied by the biasing mechanism such that movement of ring 46 in response to the force is in a direction which brings an edge of ring 46 having a smaller internal diameter closer to one or more balls 23. The resulting change in the axial position of balls 23 with respect to ring 46 limits the movement of each ball within its respective hole 42 and cams at least one ball 23 further into the interior 22 of cylinder 41. The bearing forces between the balls 23 and the shaft 69 is made only greater if an axial force is exerted on shaft 69 in a direction which also cams balls 23 further into cylinder 41. This offers improved safety and reduced risk of failure since risk of the shaft slipping through the locking mechanism results in an increase in the gripping force of the locking mechanism on the shaft.

When locking mechanism 21 is in a maximally locked position the face of second release mechanism 31 may be perpendicularly displaced from face 38 of weight assembly 20. If two weight assemblies 20 having this feature are loaded on a shaft with release mechanism 31 of the first assembly facing the release mechanism 31 of the second assembly, the two assemblies may be removed from the shaft simultaneously by pushing both release mechanisms 31 against one another to unlock both locking mechanisms and then sliding the pair along or off of the shaft in unison. Alternatively the face of release mechanism 31 may be flush or recessed from face 38 of weight assembly 20 when locking mechanism 21 is in a maximally locked position. The openings to center hole 22 may be chamfered or rounded to help facilitate passing weight assembly 20 onto the shaft.

Figure 6B:
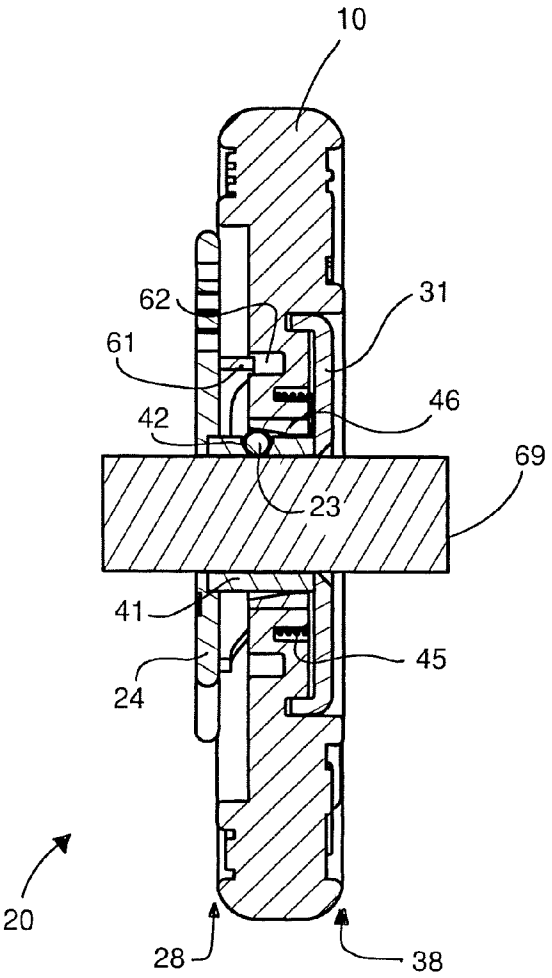
FIGS. 6A, 6B, and 6C are, respectively, a front elevation view, a cross-sectional side view, and a front isometric view of the weight assembly on a cylindrical shaft or bar shown in FIGS. 5A, 5B, and 5C with the integral locking mechanism in an unlocked configuration.
Figure 6A:
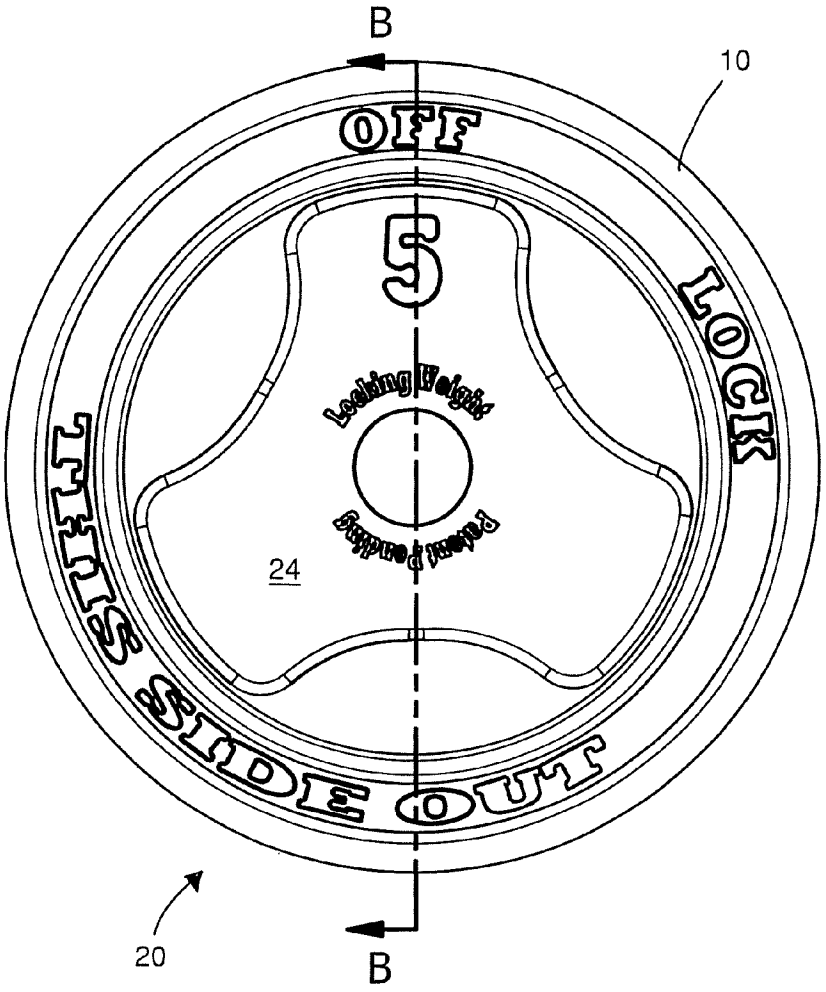
Figure 6C:
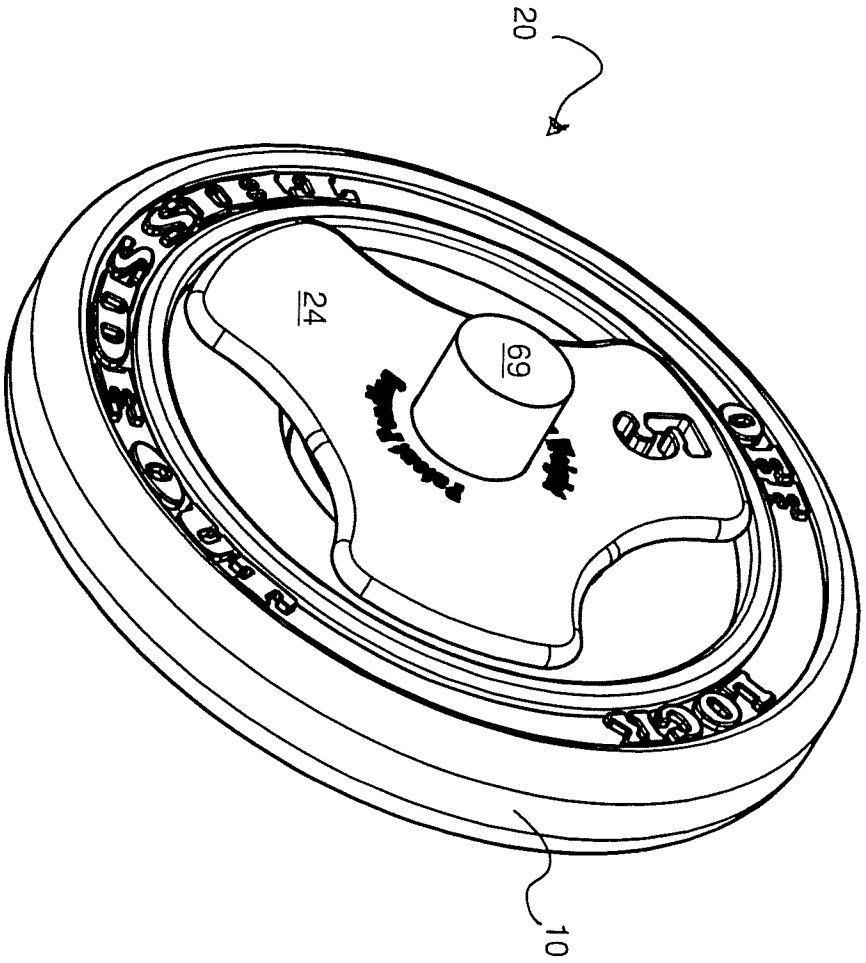

FIGS. 6A, 6B, and 6C show weight assembly 20 in an unlocked position and loaded on a shaft 69. First and second release mechanisms 24 and 31 movable with the biasing mechanism are manually actuated against the bias to move cylinder 46 in a direction opposite the direction of the force which compression spring 45 acts upon cylinder 46. Tensioning ring 46 is oriented such that movement of ring 46 in response to manual actuation against the bias brings an edge of ring 46 having a smaller internal diameter further from balls 23. The resulting change in the axial position of balls 23 with respect to ring 46 allows the balls to freely move within their respective holes, allowing the locking mechanism to be slid to a different location along shaft 69 or be removed from the shaft. When locking mechanism 21 is in a maximally unlocked position the face of first release mechanism 24 may be perpendicularly displaced from face 28 of weight assembly 20. Alternatively, the face of release mechanism 24 may be flush or recessed from face 28 of weight assembly 20 when locking mechanism 21 is in a maximally unlocked position.

First release mechanism 24 may have one or more stabilizers 61 which align with corresponding one or more recesses 62 which serve to stabilize one or more release mechanisms and minimize axial wobble of locking mechanism 21. FIGS. 5B and 6B show two stabilizers 61 and complementary recesses 62. One skilled in the art will recognize that stabilizers may or may not be needed depending on the materials used and the precision to which related dimensions of the device elements are made, for example.

Figure 7:
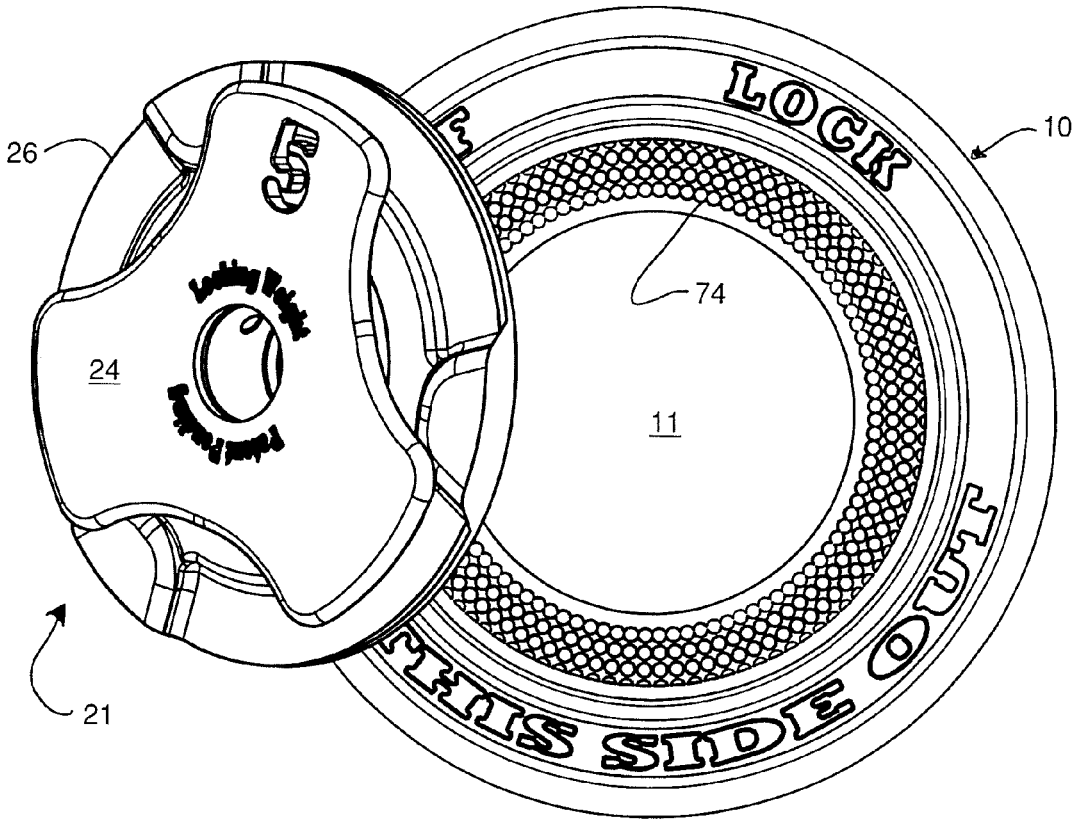
FIG. 7 is an isometric view of the weight and front face of the locking mechanism according to the present invention, the two being attachable to form a weight assembly.
Figure 8:
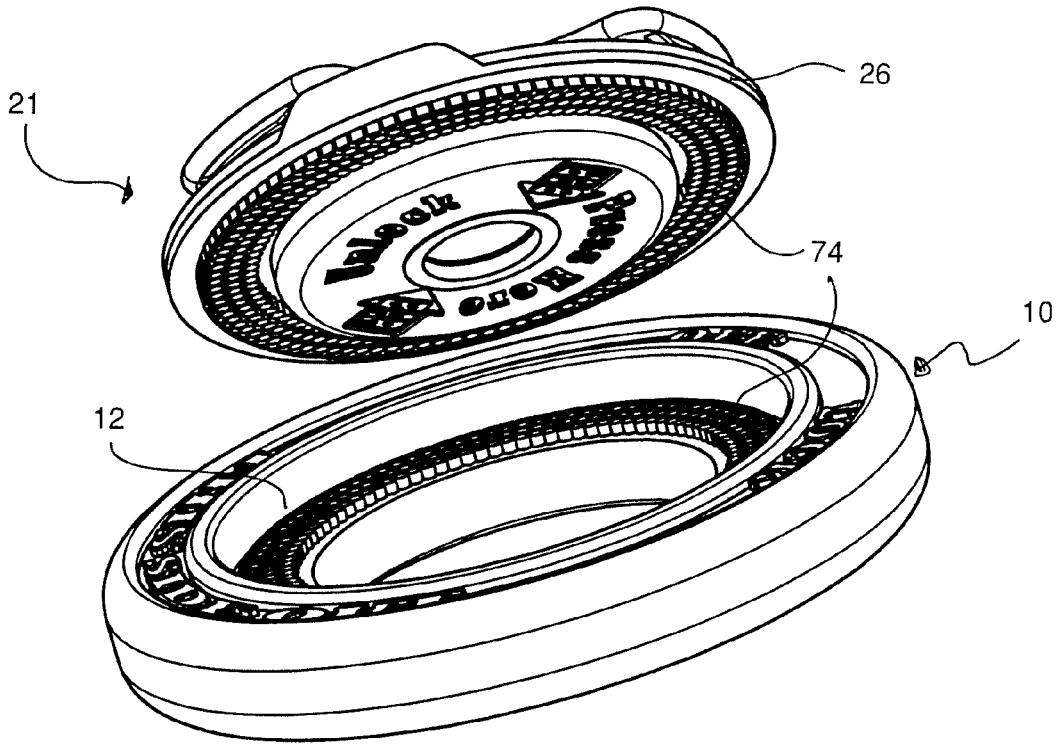
FIG. 8 is an isometric view of the weight and back face of the locking mechanism according to the present invention, the two being attachable to form a weight assembly.

Referring to FIGS. 7 and 8, weight assembly 20 comprises a weight 10 and locking mechanism 21 according to the present invention. Locking mechanism 21 is attached to weight 10 about the central hole 11 to allow for removably attaching the weight to a shaft, wherein the locking mechanism frictionally engages the shaft when in a locked position. Locking mechanism 21 may be detachable from weight 10 and selectively attachable to any one of a plurality of weights having the same or different weight amounts (e.g. 0.5 lb, 1 lb, 5 lb, 50 lb, 0.5 kg, 1 kg, 5 kg, 50 kg, etc). Recess 12 of weight 10 serves for receiving radially extending flange 26. Attachment device 74 on mating surfaces of corresponding recess 12 of weight 10 and radial flange 26 of locking mechanism 21 provides for attaching locking mechanism 21 to weight 10. Any number of attachment devices could be used to serve this purpose, for example hook and loop material sold under the trademark Velcro®, imbedded button magnets, strip magnets, press-in clips, etc. Alternatively, weight 10 and locking mechanism 21 may be integral and non-separable from one another. This may be achieved by manufacturing weight 10 and locking mechanism 21 independently and combining them by a permanent means, such as an industrial adhesive, bolts, or welding. They may also be manufactured integrally with one another.

Figure 9A:
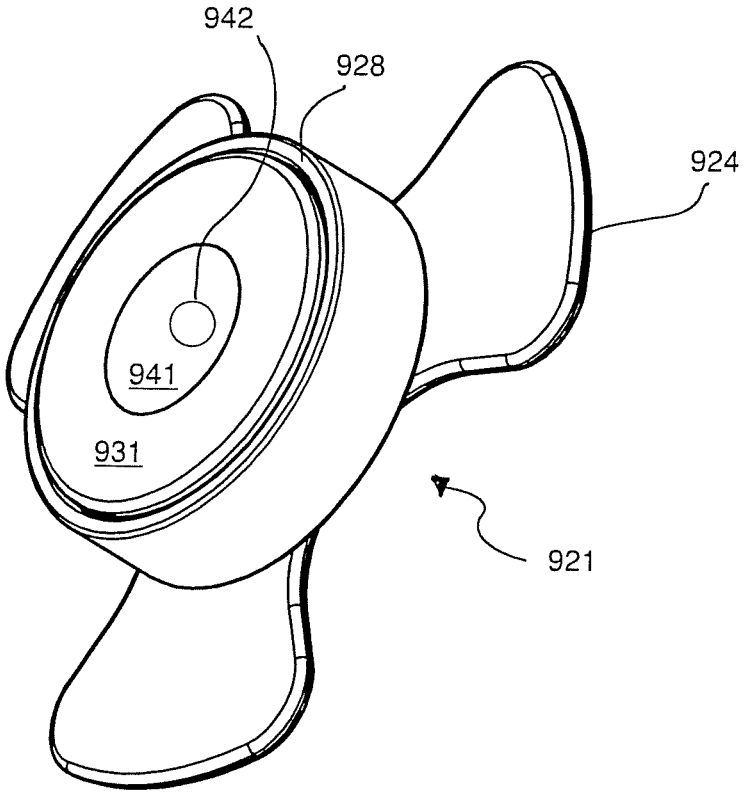
FIGS. 9A, 9B, 9C, and 9D are, respectively, a back isometric view, a side elevation view, a front elevation view, and a back elevation view of an embodiment of the locking mechanism according to the present invention in a locked configuration.
Figure 9B:
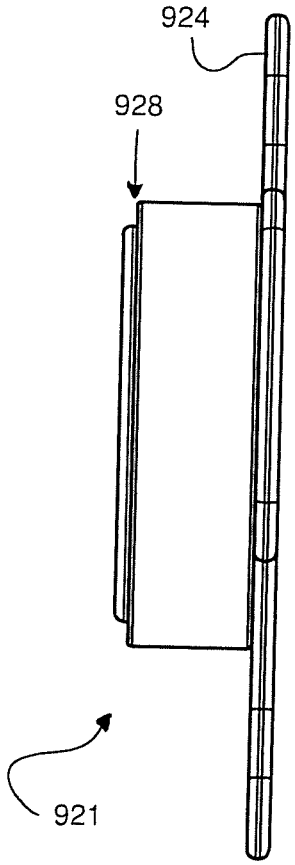
Figure 9C:
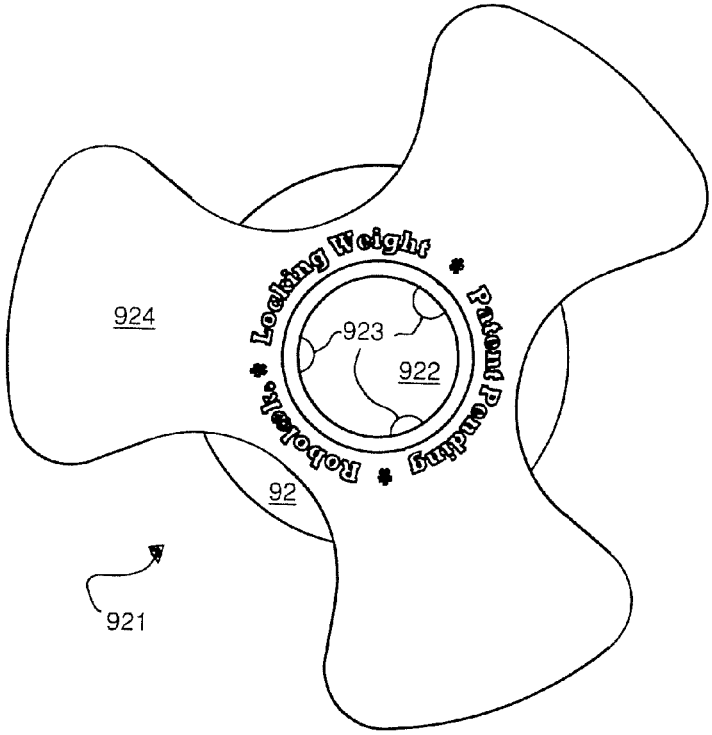
Figure 9D:
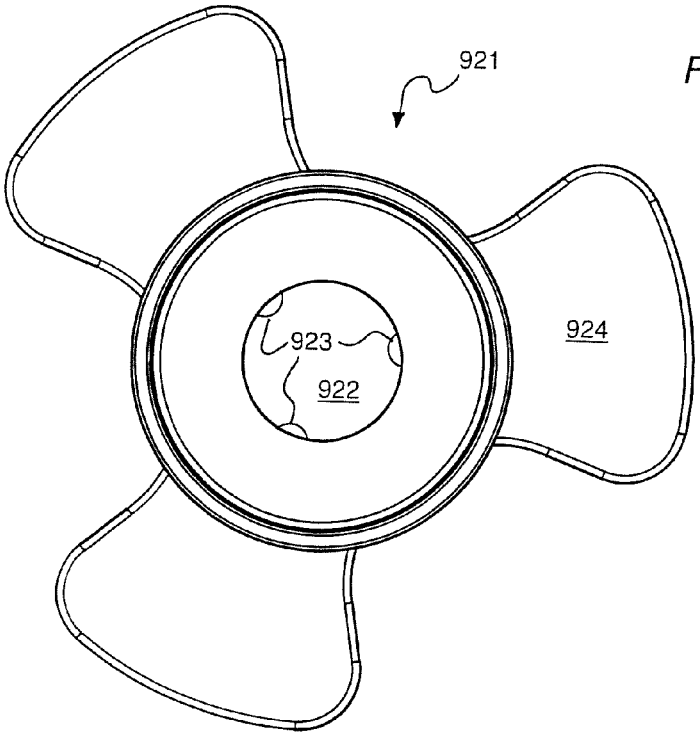
Figure 10A:
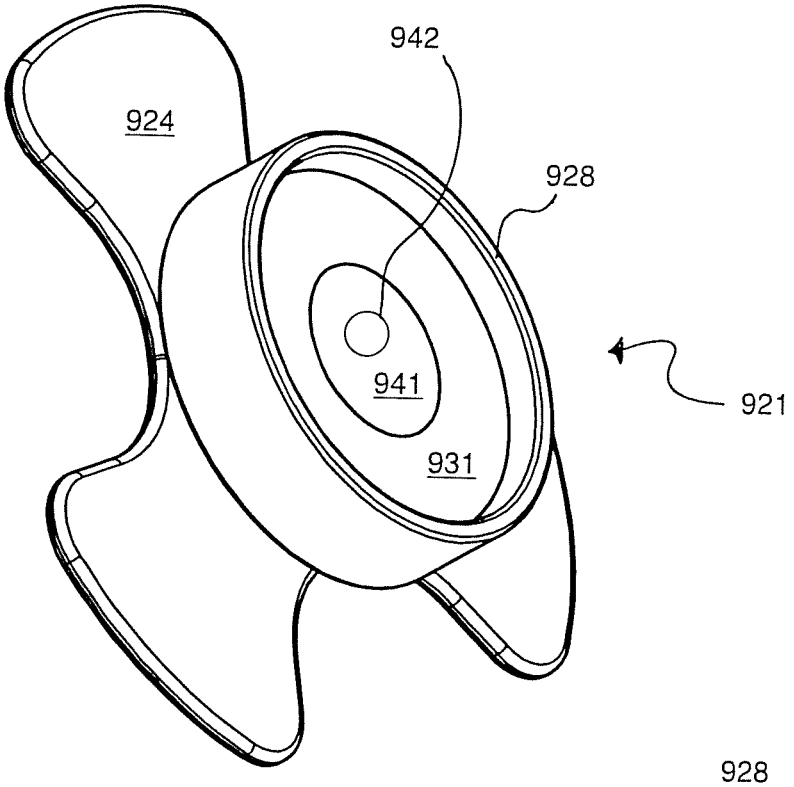
FIGS. 10A, 10B, and 10C are, respectively, a back isometric view, a side elevation view, and a front isometric view of the locking mechanism shown in FIGS. 9A, 9B, 9C, and 9D in an unlocked configuration.
Figure 10B:
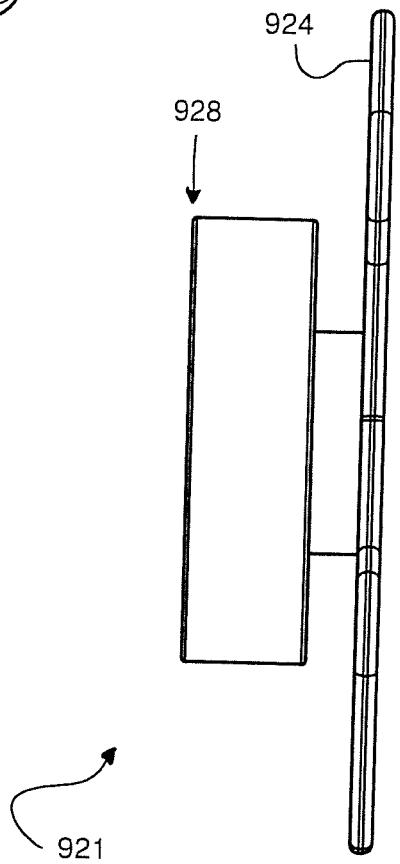
Figure 10C:
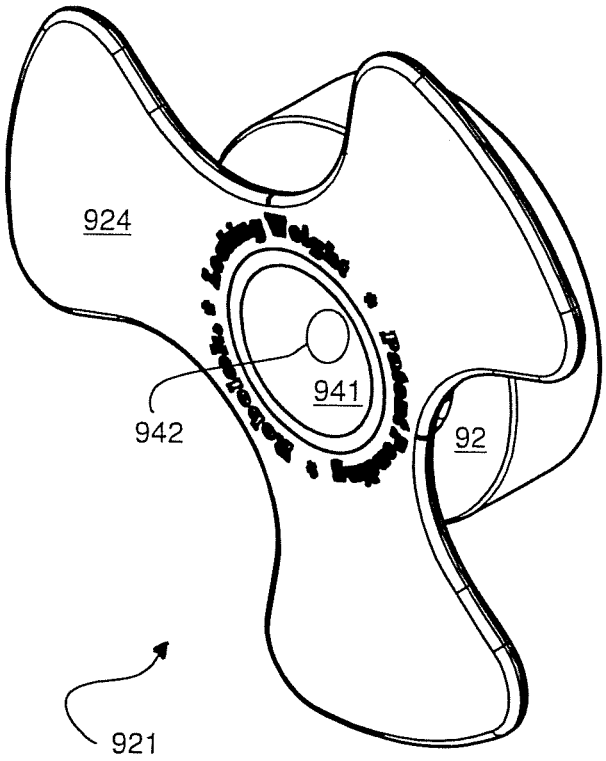
Figure 11A:
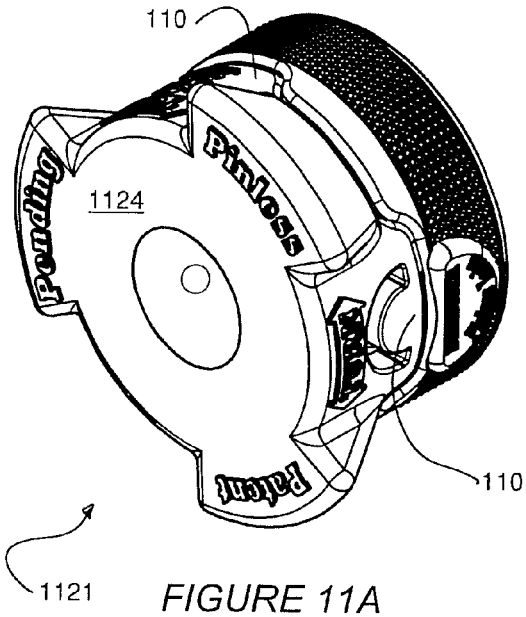
FIGS. 11A, 11B, and 11C are, respectively, a front isometric view, a back isometric view, and a side elevation view of an embodiment of the locking mechanism of the present invention in a locked configuration.
Figure 11B:
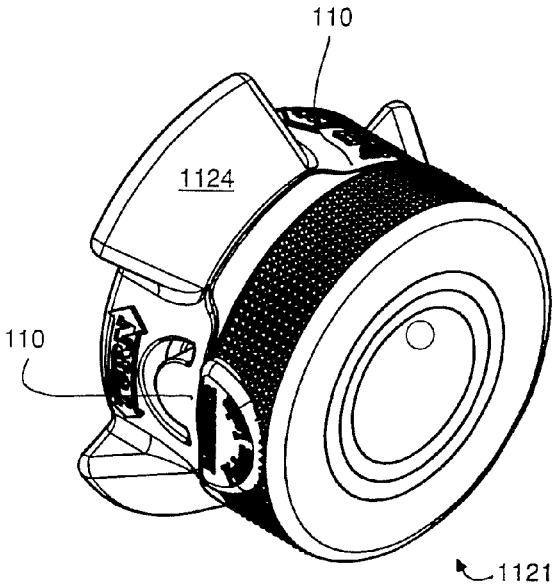
Figure 11C:
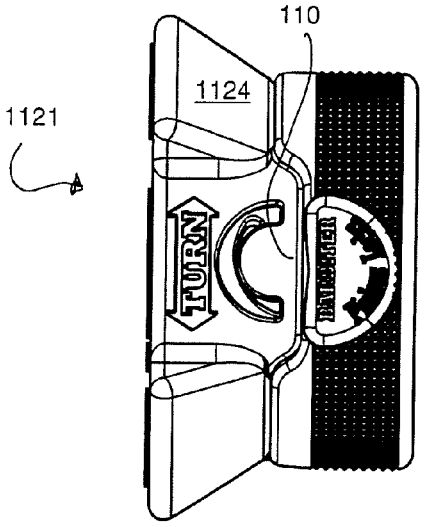
Figure 12A:
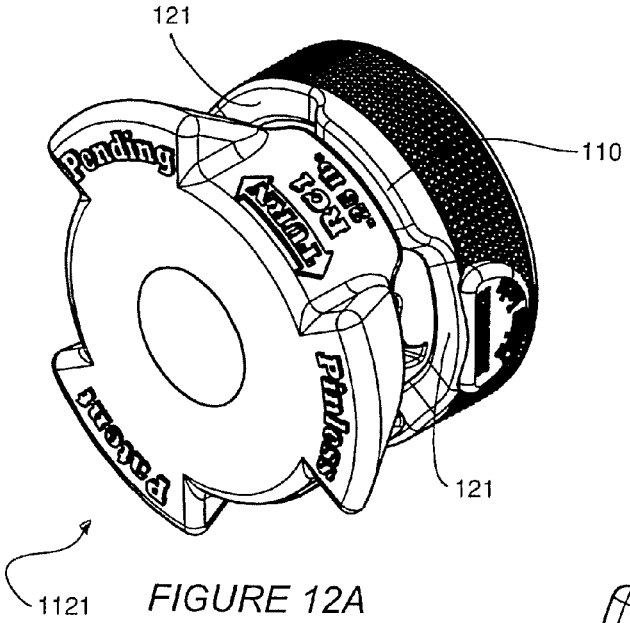
FIGS. 12A, 12B, and 12C are, respectively, a front isometric view, a back isometric view, and a side elevation view of the locking mechanism shown in FIGS. 11A, 11B, and 11C in an unlocked configuration.
Figure 12B:
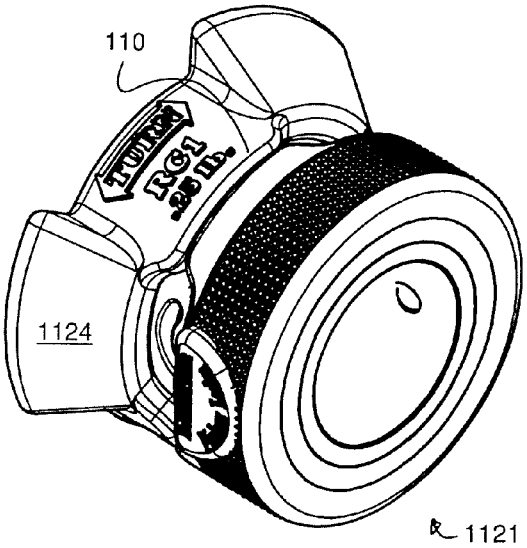
Figure 12C:
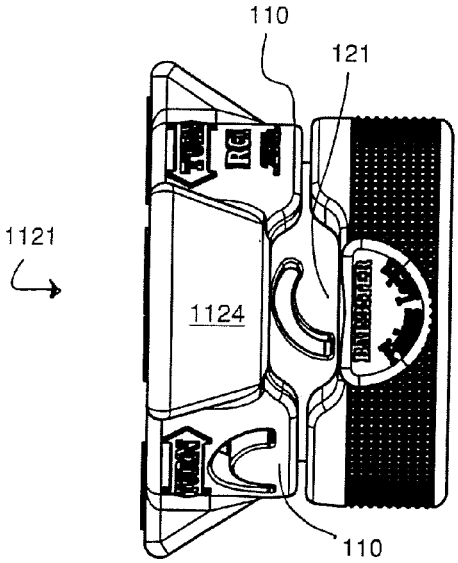

Referring to FIGS. 9A, 9B, 9C, and 9D, an alternate embodiment of the locking mechanism of the present invention is shown. Locking mechanism 921 operates analogously to locking mechanism 21 with elements analogous to a selection of elements of locking mechanism 21. At the center of locking mechanism 921 is a first cylinder 941 having at least one hole 942 each of which contains at least one ball 923. Three balls 923 are shown in FIGS. 9C and 9D partially projecting into center hole 922 while locking mechanism 921 is in a locked position. A tensioning ring (not shown) at least partially overlapping cylinder 941 serves to retain at least one ball 923 within respective holes 942. A biasing mechanism (not shown) internal to locking mechanism 921 acts against the tensioning ring to bias the device toward a locked condition. First release mechanism 924 has three wings to facilitate grasping and pulling release mechanism 924 perpendicularly with respect to surface 92 in a direction opposite the direction of the force supplied by the biasing mechanism on the tensioning ring. This serves to allow at least one ball 923 to freely move within at least one hole 942 to allow locking mechanism 921 to be slid along the shaft, on to the shaft, or off of the shaft. Second release mechanism 931 in the form of a push-button may be actuated separately from or in concert with first release mechanism 924 to change the locking mechanism from a locked position to an unlocked position. When either release mechanism is actuated, the surface of second release mechanism 931 changes plane with respect to face 928, as shown in FIG. 10A. In an alternate embodiment surface 92 may have peripheral cam surfaces about a circumferential edge which may engage mating cam surfaces on the undersides of the wings of first release mechanism 924 when first release mechanism 924 is rotated with respect to surface 92. This is just one means by which locking mechanism 921 may be selectively operable to be in an unlocked position, allowing the locking mechanism to be freely slidable along the shaft, and a locked position, securing the locking mechanism on the shaft.

With reference to FIGS. 11A through 11C and 12A through 12C, yet another embodiment of the present invention is shown. Locking mechanism 1121 operates analogously to locking mechanism 21. Release mechanism 1124 has three projecting ears 110 which are received within corresponding recesses 121 in a face of the locking mechanism when locking mechanism 1121 is in a locked position. When release mechanism 1124 is pulled and rotated, the ears engage portions of the face of the locking mechanism to maintain the locking mechanism in an unlocked position to facilitate sliding the locking mechanism on and off the shaft. Ears 110 and recesses 121 form complimentary camming surfaces such that, when the release mechanism 1124 is rotated or pulled and rotated, the camming surfaces of ears 110 ride up the camming surfaces of corresponding recesses 121 to maintain the locking mechanism in an unlocked condition to facilitate sliding the locking mechanism on and off the shaft. Although the embodiment shown comprises three ears 110 with three complementary recesses 121 in a face of the locking mechanism, one skilled in the art will recognize that there may be as few as one ear with one complementary recess, two ears and two recesses, or more than three ears and three recesses. The number of ears determines the number of degrees release mechanism 1124 must be rotated to engage or disengage the camming surfaces of the ears and the corresponding recesses. A greater number of ears results in a smaller degree of rotation required.

FIGS. 13A-13E show an embodiment of a locking mechanism 1321 which generally operates analogously to locking mechanism 21 shown in the exploded view of FIG. 4. Analogous elements are identified by corresponding reference numerals (e.g. first cylinder 41 of locking mechanism 21 corresponds with first cylinder 1341 of locking mechanism 1321). A first cylinder 1341 is slidable onto a shaft (not shown) and has a plurality of holes. Each hole is sized to retain a ball 1323 but allow a projection of the ball 1323 into an interior of the first cylinder 1341. A tensioning ring (internal and thus not visible in FIGS. 13A-13E) in the form of a second cylinder at least partially overlaps the first cylinder and retains balls 1323 within their respective holes of the first cylinder 1341. A biasing mechanism 1345 acts against the second cylinder in a first direction to urge balls 1323 into the interior of the first cylinder 1341 in order to frictionally engage a cylindrical shaft. It should be noted that in some embodiments, body 1310 may partially encase or, alternatively, entirely encase biasing mechanism 1345. A release mechanism is provided as at least one handle pair 1350 (comprising a handle 1324*a* and a handle 1310*a*), the release mechanism being movable with the biasing mechanism 1345 and manually actuated against the bias to move the second cylinder in a second direction opposite the first direction to allow the balls 1323 to freely move within the holes and allow the locking mechanism 1321 to be slid onto and removed from the shaft.

Locking mechanism 1321 may be provided with waves or ears having peripheral cam surfaces and mating cam surfaces which respectively correspond with the waves/ears of locking mechanism 21 (shown in FIG. 4 as peripheral cam surfaces 25 and mating cam surfaces 47). For locking mechanism 1321, waves with peripheral cam surfaces (not visible) are rigidly fixed relative body 1310 (e.g. attached to or integral with body 1310), and waves with mating cam surfaces are rigidly fixed relative body 1324 (e.g. attached to or integral with body 1324). It may be helpful in comparing the various example embodiments to appreciate that body 1310 may be compared to flange 26 shown in FIGS. 2A and 2B or, alternatively, the rigidly attached combination of flange 26 with weight 10. Body 1324 may be compared to the first release mechanism 24.

The peripheral cam surfaces and mating cam surfaces of locking mechanism 1321 form complimentary cam surfaces such that, when a handle 1324*a* and a handle 1310*a* of a handle pair 1350 are brought together from a splayed configuration to a collapsed configuration, the peripheral cam surfaces ride up the mating cam surfaces as, for example, discussed in conjunction with FIGS. 4, 11A-11C, and 12A-12C such that that the biasing mechanism is acted upon in a direction which unlocks the locking mechanism. The engagement of the respective peripheral and mating cam surfaces maintains the locking mechanism in an unlocked condition to facilitate sliding the locking mechanism on and off the shaft. In some embodiments, the functionality of the peripheral/mating cam surfaces of locking mechanism 1321 appreciably corresponds with the functionality described above for cam surfaces 25 and 47 in relation to locking mechanism 21 and ears 110 and recesses 121 of locking mechanism 1121.

Locking mechanism 1321 differs from some other embodiments in that it has at least six balls 1323 which bear against a shaft when mounted and locked thereon. As previously discussed, embodiments may have one or more balls for frictionally engaging a shaft. Generally, a greater number of balls should be used for shafts of larger diameter or circumference as compared to shafts of smaller diameter or circumference. For shaft sizes typical of weight lifting environments such as athletic and fitness gyms (e.g. 2 inch or less), a total of six balls 1323 was found to be an exemplary number for providing a locking grip which substantially eliminates slippage when locking mechanism 1321 is in a locked position. A greater number of balls may also be used for embodiments which are subject to greater possible loads, such as when a locking mechanism is intended for use with weight lifting bars used for heavy lifting.

Figure 13A:
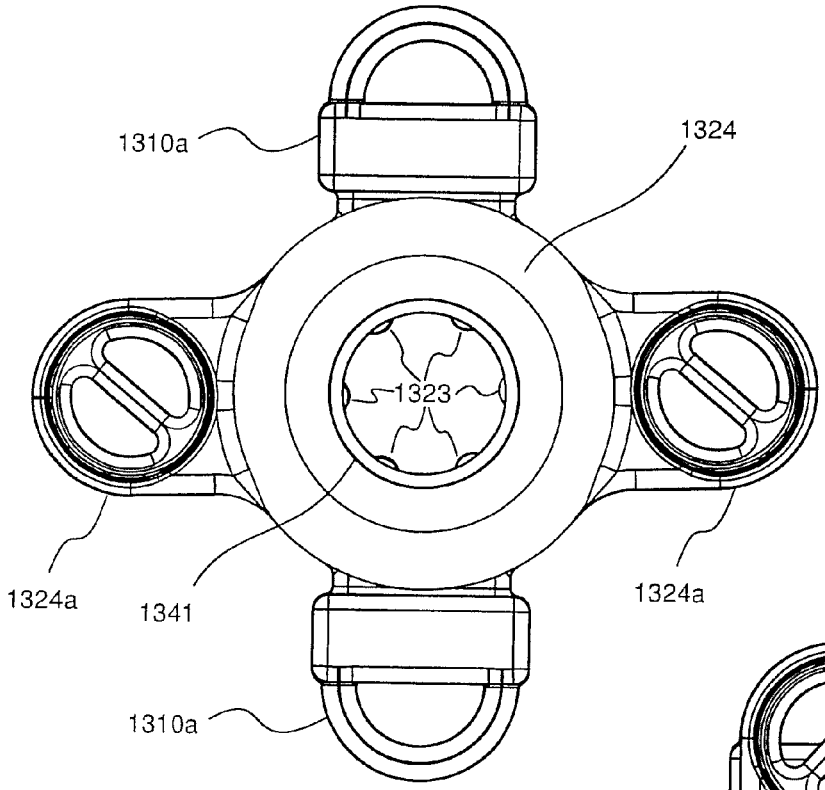
FIGS. 13A, 13B, 13C, 13D, and 13E are views of a further embodiment of a locking mechanism in locked and unlocked configurations.

Balls 1323 are generally arranged with equal spacing about an inner diameter of first cylinder 1341, such as shown in FIG. 13A. In some embodiments, however, one or more pairs of balls may have a spacing therebetween which differs from a spacing of at least one other pair of balls. It should be noted that a first pair of balls and a second pair of balls could have one ball in common.

The release mechanism (handle pair 1350) includes handles 1324*a* and 1310*a* which facilitate switching between locked and unlocked positions. One or more handles 1324*a* may be rigidly attached to or integrally formed with a body 1324, body 1324 being rigidly fixed relative first cylinder 1341. One or more handles 1310*a* may be rigidly attached to or integrally formed with body 1310, body 1310 being rigidly fixed relative the second cylinder (i.e. the tensioning ring, not visible). In some embodiments, the body 1310 fixed relative the tensioning ring has peripheral cam surfaces. The release mechanism comprises body 1324 fixed relative the first cylinder and having mating cam surfaces such that, when body 1310 is rotated relative body 1324, the peripheral cam surfaces of body 1310 ride up the mating cam surfaces of body 1324 to actuate the locking mechanism by a rotation force and maintain the locking mechanism in an unlocked condition to facilitate sliding the locking mechanism on and off a shaft.

Figure 13B:
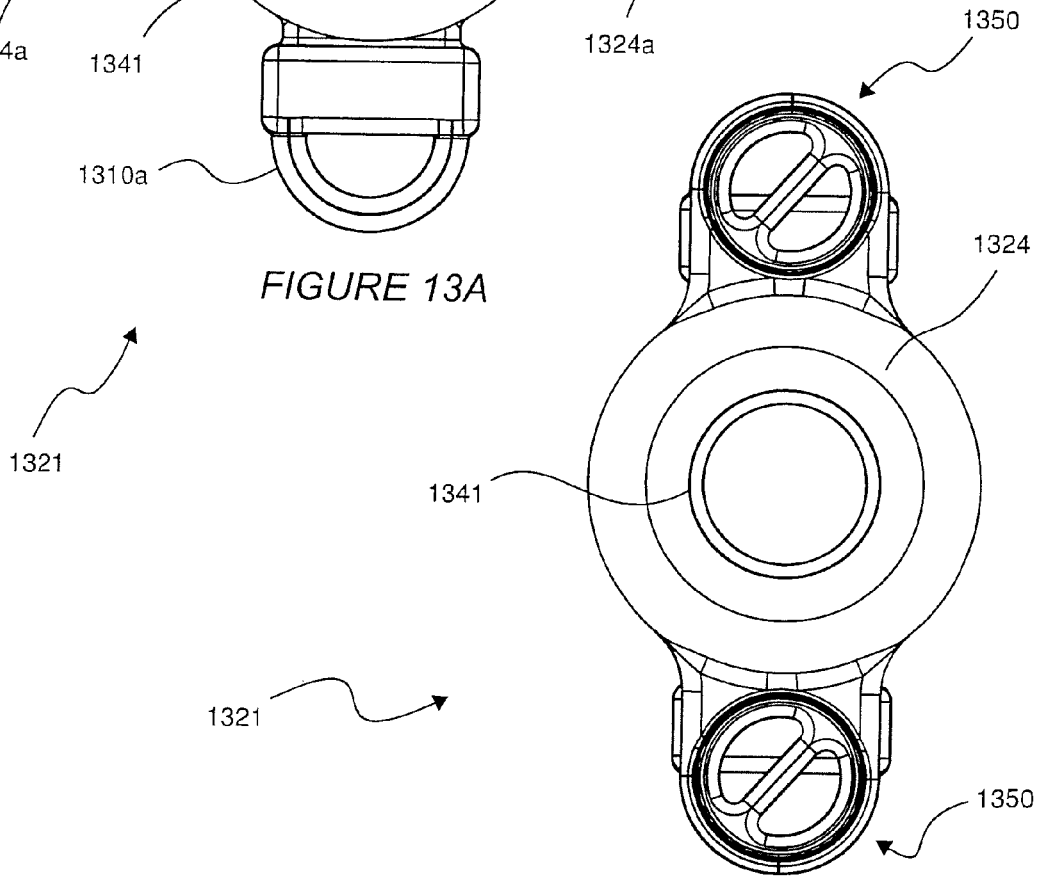
Figure 13C:
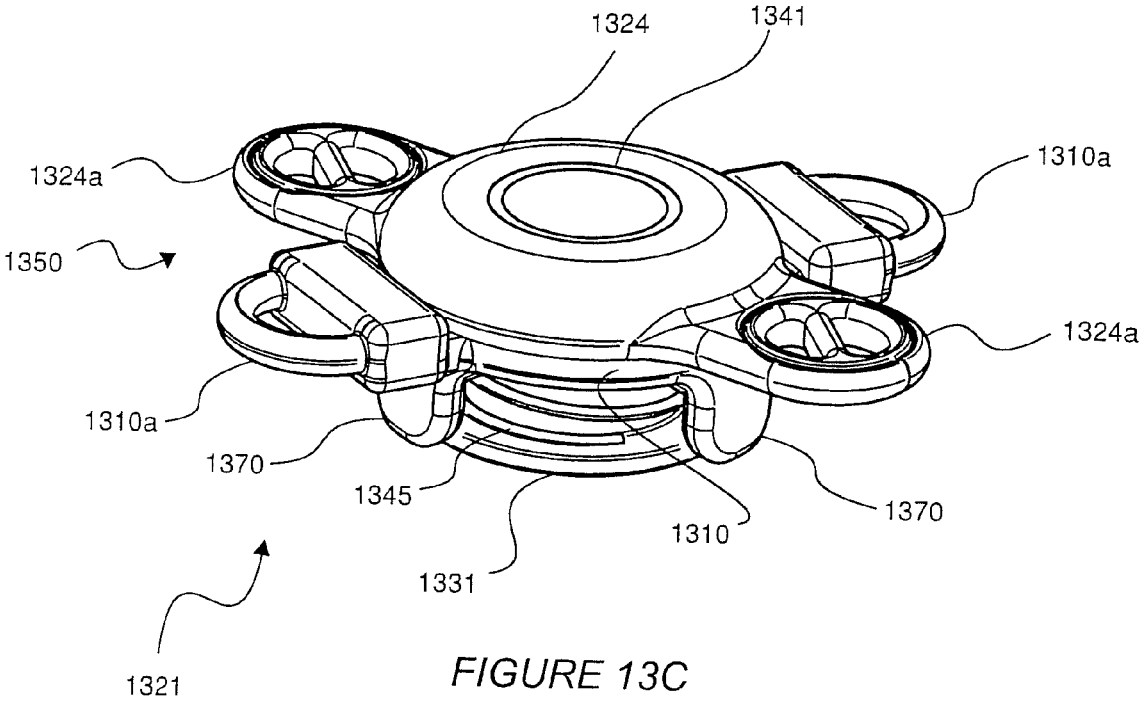
Figure 13D:
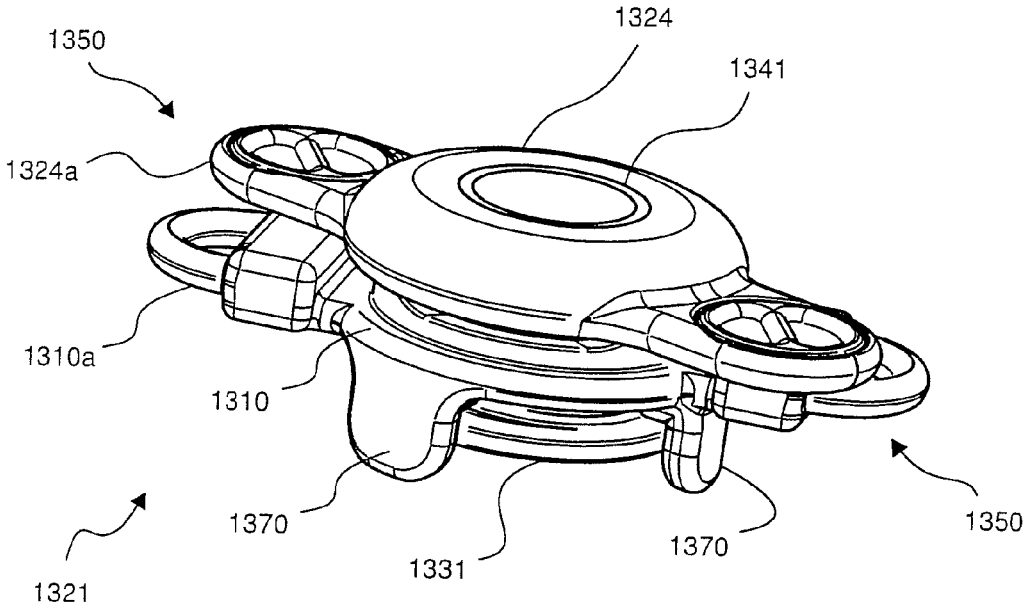
Figure 13E:
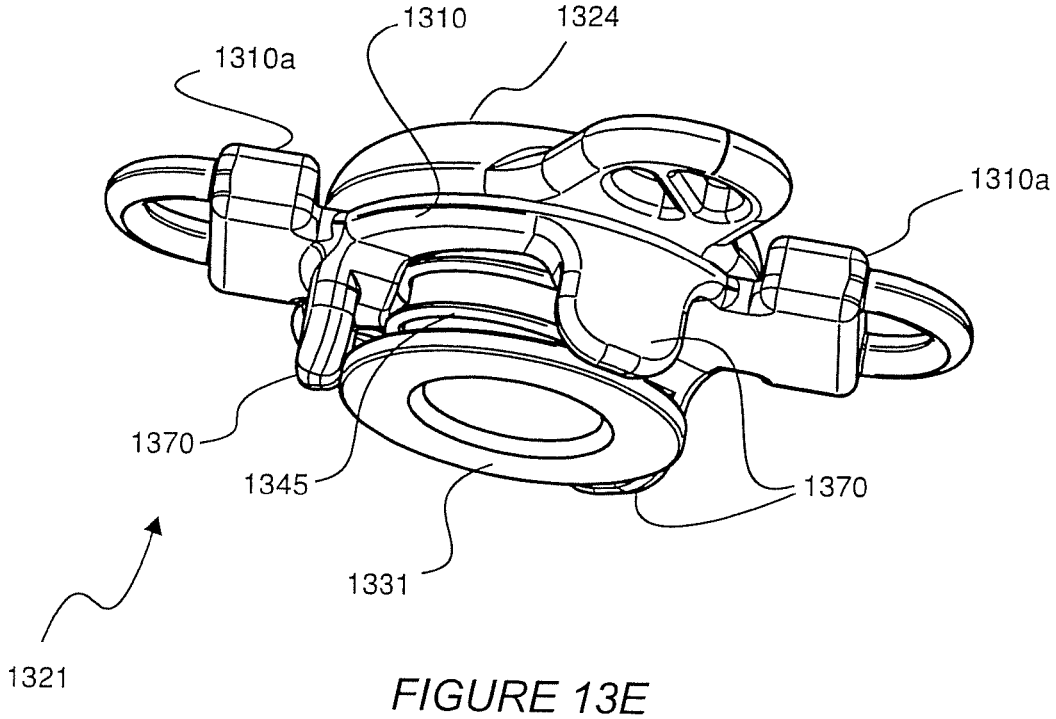

Locking mechanism 1321 is shown in locked configurations in FIGS. 13A, 13C, and 13E and unlocked configurations in FIGS. 13B and 13D. A handle pair 1350 (comprising a handle 1324*a* and a handle 1310*a*) may be arranged to allow actuation of locking mechanism 1321 with just one hand of a user, although two hands may still be used if desired. When locking mechanism 1321 is locked, a handle 1324*a* and a handle 1310*a* of a handle pair 1350 are splayed, rotationally displaced from one another such that a human hand can curl around or otherwise grip at least a portion of each handle 1324*a* and 1310*a* of the handle pair 1350. By squeezing his or her hand while gripping both splayed handles 1324*a* and 1310*a*, one or both of the handles may be rotated toward the other into a collapsed configuration. A handle 1324*a* and a handle 1310*a* may overlap completely (FIG. 13B) or partially (FIG. 13D) when in a collapsed and therefore unlocked configuration.

Overlap of handles 1324*a* and 1310*a* in a collapsed configuration (and separation of handles 1324*a* and 1310*a* in a splayed configuration) allows for manipulating the visibility and/or appearance of indicia which improve operator safety. In the case of locking mechanism 1321, each of handles 1310*a* has a first indicium which suggests a lock or locked state. Each of handles 1324*a*, on the other hand, has a second indicium which suggests nullification. In this particular example, these indicia are physical contours/shapes given to the respective handles. When in a collapsed configuration, the nullification indicia of handles 1324*a* are positioned over the lock indicia of handles 1310*a*. This communicates in a simple and easily understood manner that locking mechanism 1321 is not locked, i.e., is in an unlocked position. In contrast, handles 1310*a* and 1324*a* are splayed and do not overlap when the locking mechanism 1321 is in a locked position. The splayed configuration of the handles 1310*a* and 1324*a* provides clear visibility of the lock indicia of handles 1310*a*, communicating in a simple and effective manner that the locking mechanism is in a locked position. Thus, a user can determine by visible inspection alone whether the locking mechanism is in a locked position or an unlocked position. This improves the safety of the device, reducing the likelihood of a user accidently mounting locking mechanism 1321 on a shaft and forgetting to lock it thereon prior to using the shaft such as for weight lifting.

The indicia shown in FIGS. 13A-13E are illustrative and are not intended to limit the particular symbols or types of indicia which may be used in accordance with the invention. In other embodiments, indicia may be provided on either or both of handles 1310*a* and 1324*a* of a handle pair 1350 and may be markings, demarcations, inlays, imprints, or some other indicia. In any case, a visibility or appearance of at least one indicium changes between a locked position and an unlocked position to indicate to a user by a minimum of visual inspection whether the locking mechanism is locked or unlocked.

When a locking mechanism 1321 is in an unlocked position such as shown in FIGS. 13B and 13D, a user can switch the locking mechanism to a locked position using just one hand if so desired. A user can apply light pressure (e.g. a deliberate thumb flick) with just one or optionally both hands to a handle 1324*a* to cause rotation of handles 1324*a* (and thereby body 1324) relative to handles 1310*a* and body 1310. This is an actuation of the release mechanism (handle pair 1350) which shifts the locking mechanism 1321 into a locked position.

In some embodiments, a locking mechanism has one or more detents (not shown) which indicate to a user an optimal locked position and/or an optimal unlocked position. Such detents may cause a "click" feeling and/or sound when the respective configuration is achieved, providing tactile and/or auditory feedback to the user which confirms an optimal lock or unlock position has been reached when rotating the respective handles 1324*a* and 1310*a* relative one another.

In an alternative embodiment, at least one alternate handle pair (e.g. a second, third, and/or fourth pair) may be provided which always take the opposite configuration of a first handle pair. That is to say, when a first pair is collapsed, the alternate pair is splayed. When a first pair is splayed, the alternate pair is collapsed. The locking mechanism can be actuated from a locked position to an unlocked position and vice versa by the same hand motion: namely, gripping a handle pair and squeezing/pinching such that one or both of the handles of the pair moves toward the other into a collapsed configuration.

Although locking mechanism 1321 is shown in FIGS. 13A-13E as having two each of handles 1324*a* and 1310*a* and thus a total of two handle pairs 1350, alternative embodiments may have just one handle pair 1350 or more than two handle pairs 1350.

It should be noted that "handle" as used herein with respect to FIGS. 13A-13E is a structure or structural feature on which a human hand or a part of a human hand (e.g. a finger, a palm, etc.) may directly act upon for an actuating operation. A handle is grippable, but this may be in a conventional sense such as when a bicyclist grips a bicycle handle or some other sense, such as when a climber grips the dimpled surfaces of a rock wall. In these examples, both the bicycle handle and the dimpled surfaces of the rock wall may be described as "handles" since they are directly acted upon by the user for control.

As shown by locking mechanism 1321 in FIGS. 13C-13E, a second release mechanism 1331 may be provided which is movable with the biasing mechanism 1345 and manually actuated (e.g. by a pushing force) against the bias to move the second cylinder in the second direction opposite the first direction to allow the at least one ball 1323 to freely move within the at least one hole and allow the locking mechanism 1321 to be slid onto and removed form a shaft.

Locking mechanism 1321 may further include spacers, nubs, or projections 1370 which extend outward from one or more surfaces of either body 1324 or body 1310 of the locking mechanism 1321. Such projections 1370 provide spacing between a face of locking mechanism 1321 and whatever object or surface the movement of which is to be restricted on the shaft (e.g. a weight on a barbell or dumbbell). When locking mechanism 1321 is in use and locked to a barbell, the projections 1370 comprise the only surfaces of the locking mechanism 1321 which are in contact with a weight.

Figure 14A:
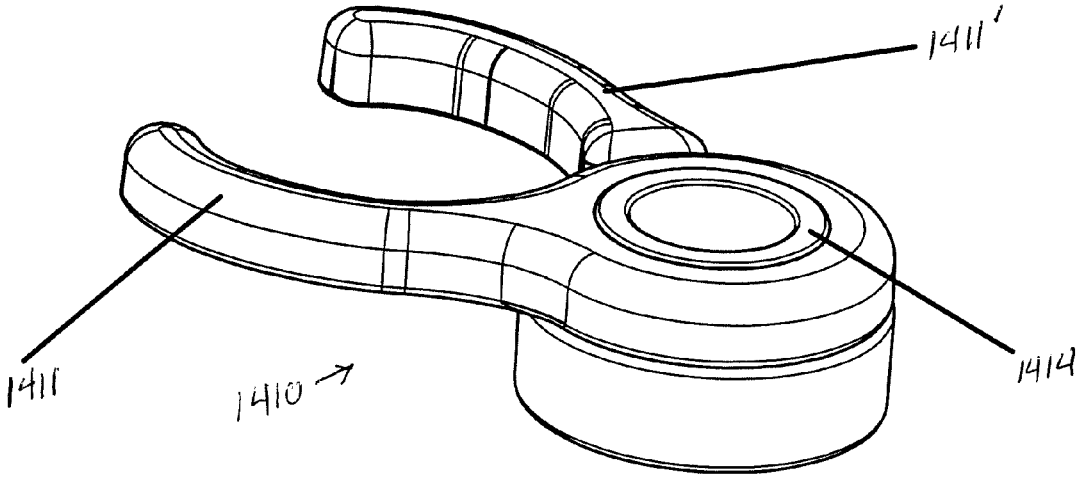
FIGS. 14A and 14B show isometric top views of a locking collar according to the present invention in a locked (FIG. 14A) and unlocked (FIG. 14B) configuration.
Figure 14B:
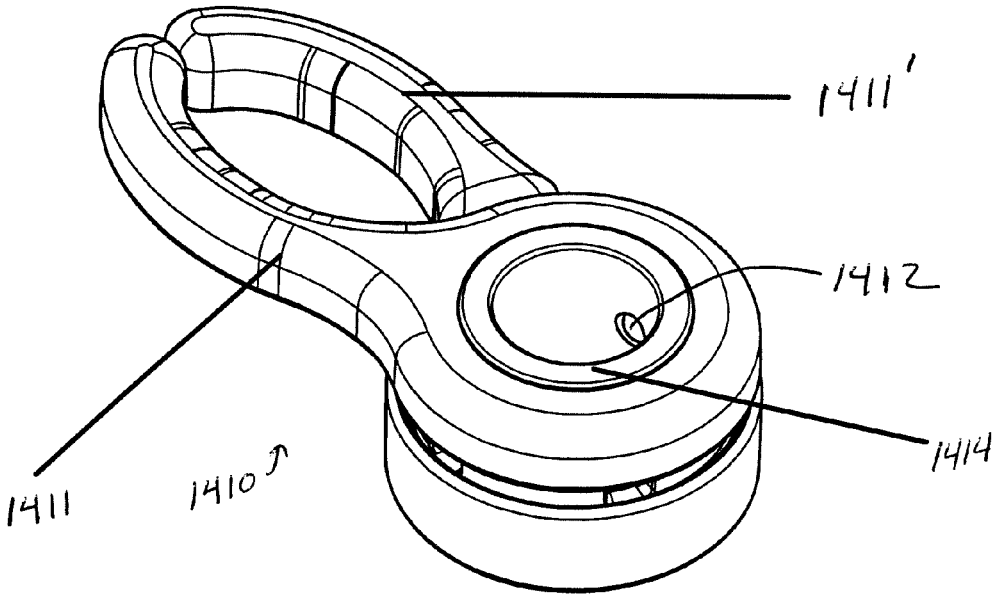

FIGS. 14A and 14B show an exemplary two handled locking collar mechanism 1410 which includes one or more ball bearing ports 1412 which frictionally engage a shaft in the same manner as the embodiments described above. In FIG. 14A, handles 1411 and 1411' are spaced apart. In this condition, the locking collar 1410 is "locked". In FIG. 14B, handles 1411 and 1411' are close together, such as would occur when a person's hand moves the handles together. In this condition, the locking collar 1410 is "unlocked". Preferably, the locking collar includes a cam arrangement as described below and/or as described below in conjunction with FIG. 16, where the locking collar 1410 is biased to the "locked" position. Thus, a person operating the locking collar 1410 squeezes the handles together to allow the collar to slide on a bar or pole in the unlocked configuration, and merely lets go to have the locking collar 1410 lock to the bar or pole. As discussed herein, the locking collar may be on a weight bar, but could also be employed in a variety of different applications (e.g., umbrella, flag pole, frame structure for stationary (e.g., scaffolding), mobile (e.g., automobile) or flying applications (e.g., drone), etc.).

Figure 15:
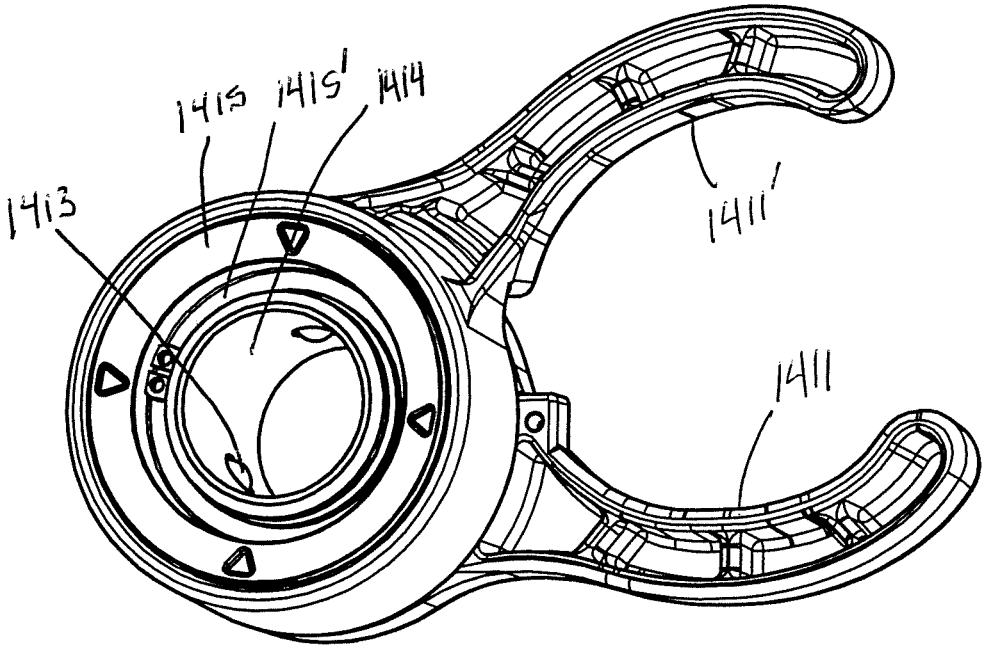
FIG. 15 shows a bottom view of the locking collar of FIG. 14A.

FIGS. 14A and 14B show that the top handle 1411 rises slightly above the lower handle 1411' as it is moved from "locked" to "unlocked" configurations. The internal cylinder 1414 can take a variety of different forms. All that is require is that operate in the manner described herein moving slightly in axial direction depending on the position of the handles 1411 and 1411' to allow the ball bearings in ports 1412 to move radially inward and outward to grip a bar or pole. FIG. 15 shows that the bottom of the locking collar mechanism 1410 can take a "less finished" look with supports and other formations made by, for example, a plastic mold being permitted to be seen. However, in some applications, the bottom might have the same "finished" look as shown in FIGS. 14A and 14B. FIG. 15 also shows the ball bearings 1413 protruding radially inward from ports 1412 for gripping a bar or pole while the locking collar is in a "locked" configuration. In addition, FIG. 15 shows that ring structures 1415 and 1415' can be provided at the end of the internal cylinder 1415 to give the locking collar a finished look. The ring structure 1415 could be imprinted with logos, trademarks, or other text.

Figure 16:
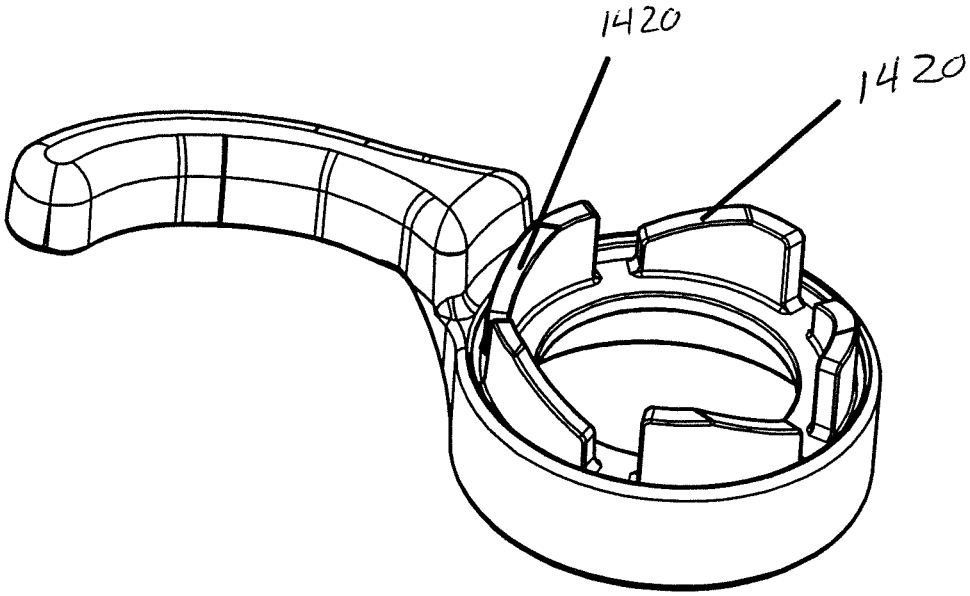
FIG. 16 shows an alternative embodiment of the peripheral cam surfaces on one of the handles of the collar embodiment shown in FIGS. 14A and 14B.
Figure 17:
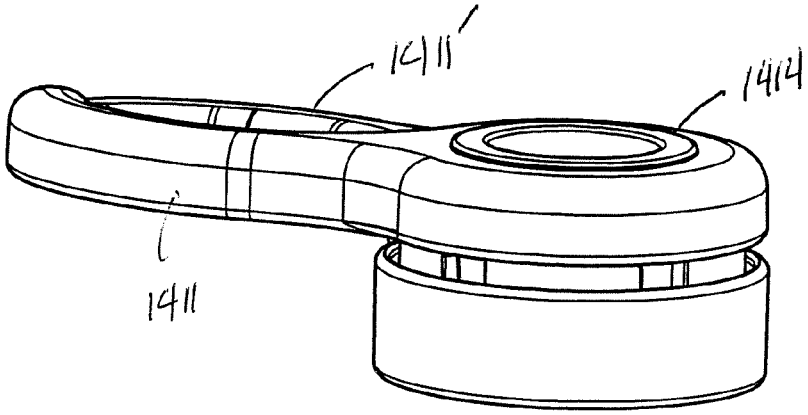
FIG. 17 shows a side view of locking collar as depicted in the unlocked position of FIG. 14B where the cam structure of FIG. 16 is utilized.

FIG. 16 shows an alternative configuration for the cam surfaces 1420 (e.g., peripheral cam surfaces or mating cam surfaces) than those shown, for example, in FIG. 4 (see, e.g., 25 and 47). For example, the cam surfaces 1420 can take the form of a plurality of separated projecting members. In the FIG. 16 embodiment, the peripheral cam surfaces and mating cam surfaces are configured to direct the release mechanism to a locked position when the pair of handles are not being manually rotated toward or away from one another. In this way, when the user of a barbell, for example, wants to release the locking mechanism 1410, he or she can rotate the handles towards one another (as shown by example in FIGS. 14A and 14B), and then he or she simply lets go of the handles and the locking mechanism 1410 slides back to a locked position due to the orientation of the cam surfaces 1420. FIG. 17 shows projecting members of FIG. 16 may be slightly visible from the side as the handles 1411 and 1411' are moved together. The cam surfaces 1420 cause a slight axial movement of the internal cylinder 1414 when the handles 1411 and 1411 are pushed together so as to release ball bearings from frictional engagement with the bar or pole. Of course, the embodiment described could be reversed for some embodiments (e.g., locking when the handles are further apart) and different handle designs as described above could be used.

Figure 19:
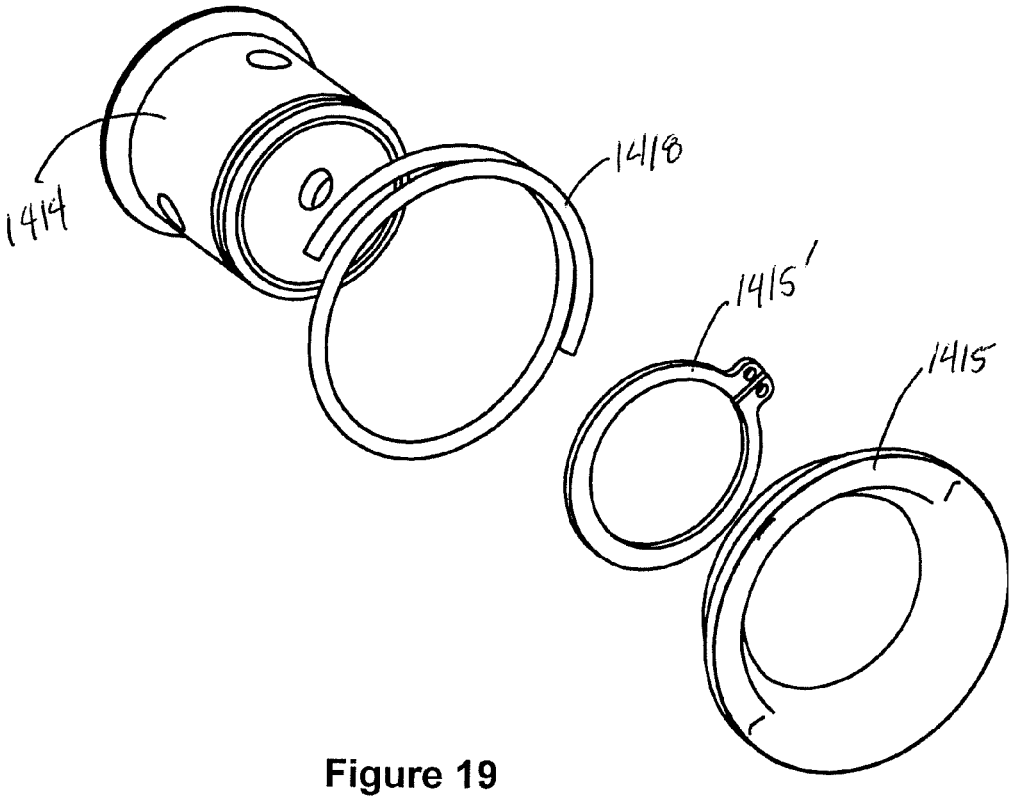
FIG. 19 shows an exploded view of the internal cylinder and related parts shown in FIGS. 18A and 18B.
Figure 18A:
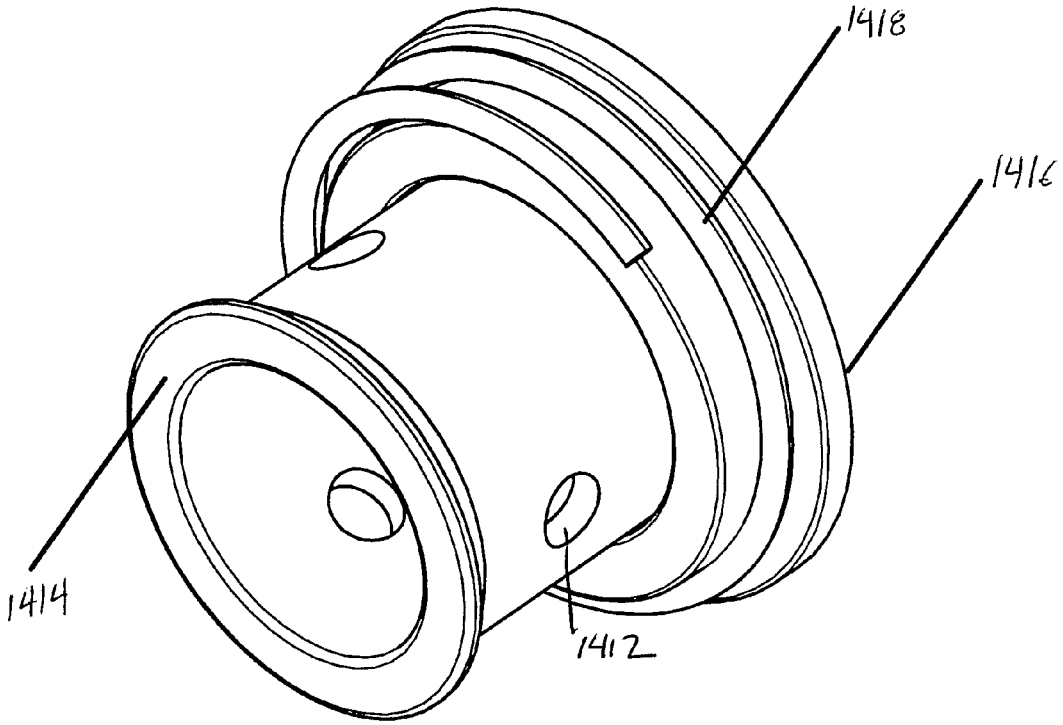
FIGS. 18A and 18B show top and bottom isometric views of the internal cylinder, tensioning ring, and biasing mechanism (e.g., spring) used in the embodiment of FIGS. 14A and 14B.
Figure 18B:
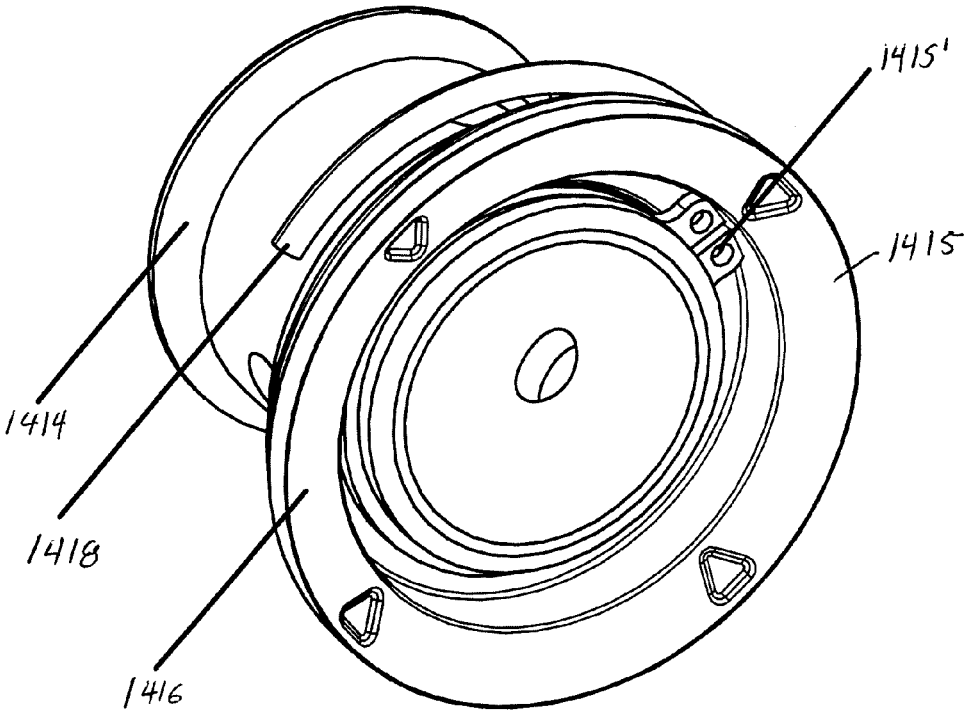

FIGS. 18A and 18B show exemplary internal features of the two handled mechanism of FIGS. 14A and 14B. These may be substantially the same as in the embodiments described above, and include an internal cylinder 1414, tensioning ring 1416, and biasing mechanism 1418 (e.g., spring). In some embodiments, the biasing mechanism 1418 could be a ribbon shaped spring, a simple round diameter spring, or some other configuration which biases the device to have the ball bearings project radially inward through ports 1412. In the design shown in FIG. 18B, the tensioning ring 1416 can be constructed from ring structures 1415 and 1415', and ring structure 1415 can display decorative attributes. FIG. 19 shows an exploded view of each of the components.

A locking mechanism according to the present invention may be used in any application requiring a locking mechanism for fixing a device or mechanism to a shaft. For instance, alternative embodiments 921, 1121, 1321, and 1410 could be used on a bar or shaft such as a barbell which is loaded with traditional weight plates common to gyms and athletic clubs. Alternatively the locking mechanism could be used in a variety of non-weight-lifting applications or simply in weight-bearing applications. It may, for example, be integrated with the telescoping stem of an office chair to allow the height of the chair to be adjusted when in the unlocked position and provide for the chair to maintain a fixed height when in the locked position. The locking mechanism may furthermore be adapted for use on a flag pole for selectively keeping a flag at mast or on an umbrella (e.g., hand held or patio) for holding open the umbrella or on a telescoping music stand which must be expanded and locked and then unlocked and collapsed. The locking mechanism may furthermore be adapted for many various industrial applications involving rollers or shafts, including but not limited to paper and fabric manufacturing. The locking mechanism may also be adapted for use in automobiles for locking wheels to the axles. This would offer the benefit of quick and convenient removal and replacement of tires. In order to increase the gripping strength of the locking mechanism on a shaft, an alternative embodiment of the locking mechanism may be made to have two, three, or more locking mechanisms which operate in unison. This would increase the gripping force of the locking mechanism on the shaft and furthermore may serve as a secondary safety feature.

The biasing mechanism may be a compression spring, such as a coil spring, or a combination of a spring and other elements, such as the first cylinder. The spring may be a wave spring or another type of spring. The forces involved in the frictional engagement of the locking mechanism on the shaft may be altered by altering the physical properties of the biasing mechanism, such as but not limited to the material (metal such as steel, polymeric material such as plastic, etc), spring pitch characteristics (pitch size, constant or variable pitch, etc), shape (conical, cylindrical, etc), and wire cross-section shape (round, square, etc). The relaxed spring length and compressed length when in the locked position may also be selected based on the desired forces involved when the locking mechanism frictionally engages the shaft. In some embodiments, the biasing mechanism comprises a plurality of springs arranged around the first and second cylinders. In such embodiments, there are preferably at least three or more such individual springs. These are generally equally spaced about the first and second cylinders so as to provide a substantially balanced force distribution. Alternatively, the biasing mechanism may comprise magnets, a rubber bushing or grommet, or another structure which supplies a bias on the tensioning ring of the locking mechanism.

The present invention may be used with a shaft made of metal, a plastic polymer, wood, or any other material. The shaft may be cylindrical (round, oval), polygonal (i.e. square, rectangular, etc), or of any other shape. The shaft may furthermore be an elongated shaft of any length. The center hole may be any shape which is compatible with the shape of the shaft which is desirable to be passed therethrough. The bar may furthermore have annular grooves; in the locked stated the balls may protrude into a groove, with the side of the groove serving as an additional bearing surface to the balls to prevent axial movement of the locking mechanism.

The inner surface of the tension ring may be smooth, knarled, or made to have some other surface property which may alter the coefficient of static friction between the tension ring and the balls which bear against it and the shaft while the locking mechanism is in a locked position.

The load bearing elements of the present invention are preferably made of metal such as steel, stainless steel, or aluminum to better resist breakage or deformation during use and offer improved safety. Metal load bearing elements are also advantageous for extending the life of the device. One skilled in the art will recognize that all the elements, including the load bearing elements, may be made of plastic, acryonitrile butadiene styrene (ABS), or any other material synthetic or natural which would maintain its shape and conformation under the loads associated with use of the device.

Although certain features and elements of the invention have been described in relation to particular illustrative embodiments, it should be understood that all features and elements disclosed are not limited to the embodiments shown and described. These serve only as illustrative examples, and features and elements of one embodiment may generally be used with some other embodiment, as will be evident to those of skill in the art.

While some embodiments of the present invention have been disclosed herein, one skilled in the art will recognize that various changes and modifications may be made without departing from the scope of the invention as defined by the following claims.

What is claimed is:

1. A locking mechanism for a shaft comprising:

a first cylinder having at least a portion of an inside diameter approximately equal to an outside diameter of the shaft allowing for the cylinder to slide freely on the shaft, the first cylinder having at least one hole;

at least one ball retained in the at least one hole of the first cylinder, the hole allowing a projection of the at least one ball into an interior of the first cylinder and small enough to retain the ball in the hole;

a tensioning ring in the form of a second cylinder at least partially overlapping the first cylinder and having an inside diameter approximately equal to an outside diameter of the first cylinder at one end of the second cylinder and at least a portion of the inside diameter increasing in diameter toward an opposite end of the second cylinder, the second cylinder serving to retain the at least one ball within the at least one hole of the first cylinder;

a biasing mechanism acting against the second cylinder in a first direction to urge the at least one ball into the interior of the first cylinder in order to frictionally engage the cylindrical shaft; and a release mechanism movable with the biasing mechanism and manually actuated against the bias to move the second cylinder in a second direction opposite the first direction to allow the at least one ball to freely move within the at least on hole and allow the locking mechanism to be slid onto and removed from the shaft, the release mechanism having at least one pair of handles of which one or both handles are rotatable toward or away from another of the handles to manually actuate the release mechanism, a first body fixed relative to the tensioning ring having peripheral cam surfaces, a second body fixed relative to the first cylinder having mating cam surfaces such that when the first body is rotated relative to the second body the peripheral and mating cam surface ride up one another to move the locking mechanism from a locked condition to an unlocked condition.

2. The locking mechanism of claim 1, wherein the peripheral cam surfaces and mating cam surfaces are configured to direct the release mechanism to a locked position when the at least one pair of handles are not being manually rotated toward or away from one another.

3. The locking mechanism of claim 1, wherein one or more of the peripheral cam surfaces and mating cam surfaces are comprised of plurality of separated projecting members.

4. The locking mechanism of claim 1, wherein the at least one ball includes at least six balls and wherein the first cylinder has at least six holes, each hole of the at least six holes retaining a ball of the at least six balls.

5. The locking mechanism of claim 1, further comprising at least one indicium allowing determination of a user by a minimum of visual inspection whether the locking mechanism is in a locked position or an unlocked position, a visibility or appearance of the at least one indicium changing between the locked position and the unlocked position.

6. The locking mechanism of claim 5, wherein the at least one indicium is on the at least one pair of handles.

7. The locking mechanism of claim 1, further comprising a second release mechanism movable with the biasing mechanism and manually actuated against the bias to move the second cylinder in the second direction opposite the first direction to allow the at least one ball to freely move within the at least one hole and allow the locking mechanism to be slid onto and removed from the shaft, the second release mechanism being actuated by a pushing force.

8. A weight and locking mechanism combination for attaching the weight to a shaft comprising:

a weight; and a locking mechanism integrated with or attachable to and detachable from said weight, said locking mechanism positionable between said weight and shaft for securing said weight to said shaft, said locking mechanism having an opening extending from a top side to a bottom side for receiving said shaft; wherein the locking mechanism comprises a first cylinder having at least a portion of an inside diameter approximately equal to an outside diameter of the shaft allowing for the cylinder to slide freely on the shaft, the first cylinder having at least one hole; at least one ball retained in the at least one hole of the first cylinder, the hole allowing a projection of the at least one ball into an interior of the first cylinder and small enough to retain the ball in the hole; a tensioning ring in the form of a second cylinder at least partially overlapping the first cylinder and having an inside diameter approximately equal to an outside diameter of the first cylinder at one end of the second cylinder and at least a portion of the inside diameter increasing in diameter toward an opposite end of the second cylinder, the second cylinder serving to retain the at least one ball within the at least one hole of the first cylinder; a biasing mechanism acting against the second cylinder in a first direction to urge the at least one ball into the interior of the first cylinder in order to frictionally engage the cylindrical shaft; and a release mechanism movable with the biasing mechanism and manually actuated against the bias to move the second cylinder in a second direction opposite the first direction to allow the at least one ball to freely move within the at least on hole and allow the locking mechanism to be slid onto and removed from the shaft, the release mechanism having at least one pair of handles of which one or both handles are rotatable toward or away from another of the handles to manually actuate the release mechanism, a first body fixed relative to the tensioning ring having peripheral cam surfaces, a second body fixed relative to the first cylinder having mating cam surfaces such that when the first body is rotated relative to the second body the peripheral and mating cam surface ride up one another to move the locking mechanism from a locked condition to an unlocked condition.

* * * * *